US007472884B2

(12) United States Patent
Nishida et al.

(10) Patent No.: US 7,472,884 B2
(45) Date of Patent: Jan. 6, 2009

(54) CONTROL UNIT FOR ELECTROMAGNETICALLY DRIVEN VALVE

(75) Inventors: Hideyuki Nishida, Suntou-gun (JP); Mikio Yokota, Toyohashi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 181 days.

(21) Appl. No.: 11/660,819

(22) PCT Filed: Sep. 1, 2005

(86) PCT No.: PCT/IB2005/002579

§ 371 (c)(1),
(2), (4) Date: Feb. 22, 2007

(87) PCT Pub. No.: WO2006/024927

PCT Pub. Date: Mar. 9, 2006

(65) Prior Publication Data

US 2007/0257221 A1 Nov. 8, 2007

(30) Foreign Application Priority Data

Sep. 3, 2004 (JP) ..... 2004-257593

(51) Int. Cl.
*F16K 31/02* (2006.01)

(52) U.S. Cl. ..... 251/129.2; 251/129.15; 137/553

(58) Field of Classification Search ..... 251/129.01, 251/129.15, 129.2; 137/553
See application file for complete search history.

(56) References Cited

U.S. PATENT DOCUMENTS

| | | | | |
|---|---|---|---|---|
| 6,262,498 | B1 | 7/2001 | Leiber | |
| 6,467,441 | B2 | 10/2002 | Cristiani et al. | |
| 6,759,640 | B2 * | 7/2004 | Yoeda et al. | 251/129.16 |
| 6,830,233 | B2 * | 12/2004 | Katsumata et al. | 251/129.1 |

FOREIGN PATENT DOCUMENTS

| | | | |
|---|---|---|---|
| DE | 197 41 570 | A1 | 3/1999 |
| EP | 1 052 381 | A2 | 11/2000 |
| EP | 1 098 072 | A1 | 5/2001 |
| EP | 1 209 328 | A2 | 5/2002 |
| JP | 09-195736 | A | 7/1997 |
| JP | 2000-097057 | A | 4/2000 |
| JP | 2000-304154 | A | 11/2000 |
| JP | 2003-314232 | A | 11/2003 |
| JP | 2006-022776 | A | 1/2006 |

* cited by examiner

*Primary Examiner*—John K Fristoe, Jr.
(74) *Attorney, Agent, or Firm*—Kenyon & Kenyon LLP

(57) ABSTRACT

When a request to start driving a drive valve has been made, the ECU performs a program including a step in which time-measurement using a timer is started; a step in which an electric current I (0) is supplied to an open/close coil; a step in which a supply of an electric current is stopped when a period of T/4 has elapsed; a step in which the electric current I (0) is supplied to the open/close coil when another period of T/4 has elapsed; and a step in which a holding current I (h) is supplied to the open/close coil when the drive valve comes close to the valve opening position.

9 Claims, 12 Drawing Sheets

CONTROL UNIT FOR ELECTROMAGNETICALLY DRIVEN VALVE

INCORPORATION BY REFERENCE

This is a 371 national phase application of PCT/IB2005/002579 filed 1 Sep. 2005, claiming priority to Japanese Patent Application No. 2004-257593 filed 3 Sep. 2004, the contents of which are incorporated herein by reference.

BACKGROUND OF THE INVENTION

1. Field of the Invention

The invention relates to a control unit for an electromagnetically driven valve. More specifically, the invention relates to a control unit which controls an electromagnetically driven valve of an internal combustion engine such that a drive valve is moved to a desired position.

2. Description of the Related Art

A conventional type of electromagnetically driven valve is disclosed in, for example, U.S. Pat. No. 6,467,441. U.S. Pat. No. 6,467,441 discloses a rotary driven type electromagnetic actuator in which a valve of an internal combustion engine operates by using both electromagnetic force and elastic force of a spring. The electromagnetic actuator includes a valve having a stem, and an oscillating arm having a first end portion that is movably supported by a support frame and a second end portion that contacts an end of the stem.

An electromagnet formed of an iron core and a coil wound around the iron core is provided on each of both sides of the oscillating arm. The electromagnetic actuator further includes a torsion bar that is provided at the first end portion of the oscillating arm and that applies force for moving the valve to the valve opening position, and a spiral spring that is provided at the outer periphery of the stem and that applies force for moving the valve to the valve closing position. The oscillating arm oscillates using the first end portion as a supporting point due to the elastic force of the torsion bar and the elastic force of the spiral spring. The movement of the oscillating arm is transferred to the stem via the second end portion, causing the valve to reciprocate between the valve opening position and the valve closing position.

An operation method of an electromagnetically driven valve is disclosed in, for example, Japanese Patent Application Publication No. 09-195736 A. Japanese Patent Application Publication No. 09-195736 A discloses the operation method of an electromagnetically driven valve, for improving a response to the operation, reducing electric power consumption, and realizing an operation suitable for a supply voltage. According to the operation method of an electromagnetically driven valve, a plunger is moved, due to electromagnetic force, from the neutral position, at which a balance is kept between the forces of springs provided on both sides of the plunger connected to a valve, in a first direction or a second direction that is opposite to the first direction. The operation method includes a starting step, a holding step, and an operating step. In the starting step, a self-excited oscillation of the plunger is caused due to electromagnetic force formed based on a first current value. In the holding step, the plunger whose amplitude has been increased due to the self-excited oscillation is attracted in the first direction and then kept attracted in the first direction due to electromagnetic force formed based on a second current value that is smaller than the first current value. The operating step includes a process in which the plunger that has been attracted in the first direction is moved in the second direction, or the plunger that has been attracted in the second direction is moved in the first direction due to electromagnetic force formed based on a third current value; a process in which the plunger is attracted in the second direction or in the first direction while the current value decreases from the third current value to a fourth current value that is smaller than the third current value; and a process in which the plunger is kept attracted in the second direction, or the plunger is kept attracted in the first direction due to electromagnetic force formed based on the fourth current value.

According to an operation method disclosed in U.S. Pat. No. 6,467,441, when the step is shifted from the starting step to the operating step, the plunger is moved with high response. In the operating step, the plunger is gently attracted in the first or second direction, and, therefore, electric power consumption can be suppressed.

Japanese Patent Application Publication No. 09-195736 A discloses a parallel driven type electromagnetically driven valve in which two electromagnets are arranged in the axial direction of a valve stem. Accordingly, the height of the electromagnetically driven valve becomes high, making it difficult to satisfy a requirement concerning a height of the electromagnetically driven valve to be mounted in an engine when the electromagnetically driven valve is used as an intake/exhaust valve of the engine for a vehicle or the like. Concerning the rotary driven type electromagnetic actuator disclosed in U.S. Pat. No. 6,467,441, the height of the actuator is reduced to some extent by providing the torsion bar at the second end portion of the oscillating arm. However, as in the case of the electromagnetically driven valve disclosed in Japanese Patent Application Publication No. 09-195736 A, since the spiral spring is provided at the outer periphery of the stem, the height of the actuator cannot be made sufficiently low.

In the electromagnetic actuator disclosed in U.S. Pat. No. 6,467,441, two electromagnets are arranged in the axial direction of the stem. Similarly, in the electromagnetically driven valve disclosed in Japanese Patent Application Publication No. 09-195736 A, two electromagnets are arranged in the axial direction of the valve stem. The electromagnets one of which is provided for opening the valve and the other of which is provided for closing the valve contribute an increase in the height of the electromagnetic actuator or the electromagnetically driven valve.

Accordingly, it is considered that, for example, one of the two electromagnets is omitted in order to reduce the height of the electromagnetically driven valve. In this case, however, even if the operation method of the electromagnetically driven valve disclosed in Japanese Patent Application Publication No. 09-195736 A is applied to the case where only one electromagnet is provided, the drive valve cannot be controlled to a desired position.

The European patent application EP 1 209 328 A2 further discloses a control method for an electromagnetic actuator for the control of an engine valve in which at least one electromagnet displaces an actuator body under the action of the force of magnetic attraction generated by the electromagnet, the electrical supply of the electromagnet being controlled as a function of an objective value of the magnetic flux circulating in the magnetic circuit formed by the electromagnet and the actuator body.

Further, the European patent application EP 1 098 072 A1 discloses a method for the control of electromagnetic actuators for the actuation of intake and exhaust valves in internal combustion engines, wherein an actual position and an actual velocity of the valve as well as a reference position and a reference velocity are determined and the differences between the reference position and the actual position as well as between the reference velocity and the actual velocity of the valve are minimized by means of a feedback control action.

SUMMARY OF THE INVENTION

The invention is made in order to solve the above-mentioned problems. It is, therefore, an object to provide a control unit for an electromagnetically driven valve which performs efficient control based on a structure of an electromagnetically driven valve.

According to an aspect of the invention, there is provided a control unit for an electromagnetically driven valve which operates by using both electromagnetic force and elastic force, and which is provided with a drive valve that includes a valve stem and that reciprocates between a first position and a second position in a direction in which the valve stem extends; an oscillation member which is connected to the valve stem; an elastic member which applies elastic force to the oscillation member such that the drive valve is held at a predetermined position between the first position and the second position; and a magnetic force generating device for applying electromagnetic force to the oscillation member based on electric power supplied to the magnetic force generating device. In the electromagnetically driven valve, the magnetic force generating device applies electromagnetic force for moving the drive valve toward the first position and electromagnetic force for moving the drive valve toward the second position, which is equal to the electromagnetic force for moving the drive valve toward the first position, to the oscillation member, if the electric power is applied to the magnetic force generating device when the drive valve is at a center position between the first position and the second position. The predetermined position is deviated from the center position toward the first position or the second position. The control unit for this electromagnetically driven valve is characterized by including an electric power supplying device for supplying electric power to the magnetic force generating device; a detecting device for detecting a movement amount of the drive valve; and a control device for controlling a supply of electric power to the magnetic force generating device according to one of an oscillation cycle based on the elastic force and the movement amount of the drive valve.

The control device may control an electric power supply period and an electric power supply stopped period according to the oscillation cycle based on the elastic force, and may perform control such that an amount of electric power supplied to the magnetic force generating device becomes equal to a predetermined amount of electric power, when the movement amount becomes equal to a predetermined movement amount.

With the control unit for an electromagnetically driven valve having the above-mentioned structure, the drive valve reciprocates between the first position and the second position. The drive valve is held at the predetermined position between the first position and the second position by the elastic member. The magnetic force generating device (e.g. an electromagnet) applies the electromagnetic force for moving the drive valve toward the first position and the electromagnetic force for moving the drive valve toward the second position, which is equal to the electromagnetic force for moving the drive valve toward the first position, to the oscillation member, if the electric power is applied to the magnetic force generating device when the drive valve is at the center position between the first position and the second position. In the control unit for controlling the electromagnetically driven valve thus configured, the electric power supplying device supplies electric power to the magnetic force generating device (e.g. the electromagnet), and the control means controls the supply of the electric power to the magnetic force generating device according to one of the oscillation cycle T based on the elastic force and the movement amount of the drive valve. The control device controls the electric power supply period and the electric power supply stopped period according to the oscillation cycle T based on the elastic force. The electric power supply period in which electric power is supplied to the magnetic force generating device is a period of T/4 corresponding to a period from when the drive valve starts moving from the center position until when the drive valve reaches a position (extreme value) at which the drive valve is furthest from the center position, when the drive valve reciprocates. The electric power supply stopped period in which electric power supply to the magnetic force generating device is stopped is a period of T/4 corresponding to a period from when the drive valve starts moving from the position (extreme value) at which the drive valve is furthest from the center position until when the drive valve reaches the center position.

Since drive valve is held at a position which is deviated from the center position toward the first position or the second position (e.g. a position below the center position), the drive valve is attracted by the electromagnetic force generated by the magnetic force generating-device and moves downward from the center position in the first electric power supply period of T/4. In the electric power supply stopped period of T/4, since electromagnetic force is not applied to the drive valve, force for returning the drive valve to the center position is applied to the drive valve due to the elastic force of the elastic member. When electric power is supplied to the magnetic force generating device again after the period of T/4 that corresponds to a period from when the supply of electric power is stopped until when the drive valve is returned to the center position has elapsed, the drive valve moves upward due to an inertiforce and the electromagnetic force. If supplying electric power during the period of T/4 and stopping the supply of electric power during the period of T/4 are repeated in this manner, the extreme value of the movement amount of the drive valve can be increased. Therefore, the drive valve can be moved to a desired position from among the first position and the second position (e.g. the valve opening position and the valve closing position). Since supplying electric power during the period of T/4 and stopping the supply of electric power during the period of T/4 are repeated, electric power consumption can be suppressed.

When the movement amount becomes equal to the predetermined movement amount, control is performed such that the amount of electric power supplied to the magnetic force generating device becomes equal to the predetermined amount of electric power. The amount of electric power required to keep the drive valve attracted at the valve opening position or the valve closing position is smaller than the amount of electric power supplied when the movement of the drive valve is controlled. Accordingly, for example, when the movement amount becomes equal to the predetermined movement amount corresponding to the valve opening position or the valve closing position, the amount of electric power supplied to the magnetic force generating device is set to the amount of electric power required to keep the drive valve attracted at the valve opening position or the valve closing position, whereby electric power consumption can be suppressed. It is, therefore, possible to provide the control unit for an electromagnetically driven valve which performs efficient control based on the structure of the electromagnetically driven valve.

The control device may control the electric power supply period and the electric power supply stopped period according to the oscillation cycle based on the elastic force; may determine whether the movement amount is in a predetermined range; may perform control such that the electric power is supplied to the magnetic force generating device, when it is determined that the movement amount is changed from a value in the predetermined range to a value outside the predetermined range; may determine whether a time-change-rate of the movement amount is in a predetermined range, and may perform control such that the supply of electric power to the magnetic force generating device is stopped, when it is determined that the time-change-rate is changed from a value outside the predetermined range to a value in the predetermined range.

With the control unit for an electromagnetically driven valve having the above-mentioned structure, the drive valve reciprocates between the first position and the second position. The drive valve is held at the predetermined position between the first position and the second position by the elastic member. The magnetic force generating device (e.g. an electromagnet) applies the electromagnetic force for moving the drive valve toward the first position and the electromagnetic force for moving the drive valve toward the second position, which is equal to the electromagnetic force for moving the drive valve toward the first position, to the oscillation member, if the electric power is applied to the magnetic force generating device when the drive valve is at the center position between the first position and the second position. In the control unit for controlling the electromagnetically driven valve thus configured, the electric power supplying device supplies electric power to the magnetic force generating device (e.g. the electromagnet), and the control device controls the supply of the electric power to the magnetic force generating device according to the oscillation cycle T based on the elastic force. The drive valve is held at a position which is deviated from the center position toward the first position or the second position (e.g. a position below the center position). Accordingly, controlling the electric power supply period and the electric power supply stopped period according to the oscillation cycle makes it possible to cause the drive valve to perform a self-excited oscillation.

When it is determined that the movement amount of the drive valve is changed from a value in the predetermined range to a value outside the predetermined range, control is performed such that electric power is supplied to the magnetic force generating device. For example, if the predetermined range is set by using the center position as a reference position, when the movement amount is changed from a value in the predetermined range to a value outside the predetermined range, the drive valve is near the center position and is moving toward the first position or the second position (e.g. the valve opening position or the valve closing position). At this time, if electric power is supplied to the magnetic force generating device, thereby causing the magnetic force generating device to generate electromagnetic force, a resultant force of the electromagnetic forces is applied to the drive valve in the same direction as the direction in which the drive valve moves. Accordingly, the extreme value of the movement amount of the drive valve is increased. When it is determined that a time-change-rate of the movement amount of the drive valve is changed from a value outside the predetermined range to a value in a value in the predetermined range, control is performed such that the supply of electric power to the magnetic force generating device is stopped. For example, if the predetermined range is set to a rage for a low speed region, the position at which the time-change-rate is changed from a value outside the predetermined range to a value in the predetermined range is a position at which the time-change-rate of the movement amount of the drive valve becomes lower. The position at which the time-change-rate becomes lower is a position at which the movement amount of the drive valve becomes the extreme value. Therefore, the supply of power to the magnetic force generating device is stopped. Accordingly, electromagnetic force is not applied to the drive valve, and only the elastic force of the elastic member for attempting to hold the drive valve at the center position is applied to the drive valve. Accordingly, the time-change-rate of the movement amount of the drive valve increases as the drive valve comes closer to the center position. If the electromagnetically driven valve is controlled in this manner, the extreme value of the movement amount of the drive valve is increased, and the drive valve can be moved to a desired position from among the valve opening position and the valve closing position. Since supplying electric power and stopping the supply of electric power are repeated, electric power consumption can be suppressed. It is, therefore, possible to provide the control unit for an electromagnetically driven valve which performs efficient control based on the structure of the electromagnetically driven valve.

The oscillation member may be formed of a first oscillation member and a second oscillation member which are provided at a predetermined distance from each other; and the control device may control an electric power supply period and an electric power supply stopped period according to the oscillation cycle based on the elastic force, may calculate a first distance between the first oscillation member and a predetermined reference position based on the movement amount, may calculate a second distance between the second oscillation member and the reference position based on the movement amount, may perform control such that the electric power is supplied to the magnetic force generating device when an absolute value of a difference between the first distance and the second distance is larger than a predetermined distance, and may perform control such that the supply of electric power to the magnetic force generating device is stopped when the absolute value of the difference between the first distance and the second distance is equal to or smaller than the predetermined distance.

With the control unit for an electromagnetically driven valve having the above-mentioned structure, the drive valve reciprocates between the first position and the second position. The drive valve is held at the predetermined position between the first position and the second position by the elastic member. The magnetic force generating device (e.g. an electromagnet) applies the electromagnetic force for moving the drive valve toward the first position and the electromagnetic force for moving the drive valve toward the second position, which is equal to the electromagnetic force for moving the drive valve toward the first position, to the first oscillation member and the second oscillation member, if the electric power is applied to the magnetic force generating device when the drive valve is at the center position between the first position and the second position. In the control unit for controlling the electromagnetically driven valve thus configured, the electric power supplying device supplies electric power to the magnetic force generating device (e.g. the electromagnet), and the control device controls the supply of the electric power to the magnetic force generating device according to the oscillation cycle T based on the elastic force. The drive valve is held at a position which is deviated from the center position toward the first position or the second position (e.g. a position below the center position). Accordingly, controlling the electric power supply period and the electric power supply stopped period according to the oscillation cycle makes it possible to cause the drive valve to perform a self-excited oscillation.

The first distance between the first oscillation member and the predetermined reference position (e.g. a core of the electromagnet) is calculated based on the movement amount of the drive valve. Also, the second distance between the second oscillation member and the reference position is calculated based on the movement amount of the drive valve. When the absolute value of the difference between the first distance and the second distance is smaller than the predetermined value, the drive valve is near the center position. While the drive valve is near the center position, even if electric power is supplied to the magnetic force generating device so as to cause the magnetic force generating device to generate electromagnetic force, a resultant force of the electromagnetic forces applied to the drive valve is small, and electric power consumption is increased. Accordingly, supplying electric power to magnetic force generating device (e.g. the electromagnet) when the absolute value of the difference between the first distance and the second distance is larger than the predetermined value makes it possible to increase the resultant force of the electromagnetic forces applied to the drive valve, thereby increasing the extreme value of the movement amount of the drive valve. Therefore, the drive valve can be moved to the desired position from among the valve closing position and the valve opening position. Also, stopping the supply of electric power to the magnetic force generating device (e.g. the electromagnet) when the absolute value of the difference between the first distance and the second distance is equal to or smaller than the predetermined value makes it possible to suppress electric power consumption. It is, therefore, possible to provide the control unit for an electromagnetically driven valve which performs efficient control based on the structure of the electromagnetically driven valve.

The control means may supply the electric power to the magnetic force generating device until the movement amount becomes equal to a predetermined movement amount; may perform control such that the supply of electric power to the magnetic force generating device is stopped, when the movement amount becomes equal to the predetermined movement amount, and may perform control such that the electric power is supplied to the magnetic force generating device, when a position of the drive valve based on the movement amount becomes the center position.

With the control unit for an electromagnetically driven valve having the above-mentioned structure, the drive valve reciprocates between the first position and the second position. The drive valve is held at the predetermined position between the first position and the second position by the elastic member. The magnetic force generating device (e.g. an electromagnet) applies the electromagnetic force for moving the drive valve toward the first position and the electromagnetic force for moving the drive valve toward the second position, which is equal to the electromagnetic force for moving the drive valve toward the first position, to the oscillation member, if the electric power is applied to the magnetic force generating device when the drive valve is at the center position between the first position and the second position. In the control unit for controlling the electromagnetically driven valve thus configured, the electric power supplying device supplies electric power to the magnetic force generating device (e.g. the electromagnet), and the control device performs control until the movement amount of the drive valve becomes equal to the predetermined movement amount. Since the drive valve is held at a position which is deviated from the center position toward the first position or the second position (e.g. a position below the center position), the drive valve moves downward when the electromagnetic force generated by the magnetic force generating device is applied. The control device performs control such that the supply of electric power to the magnetic force generating device is stopped, when the movement amount of the drive valve becomes equal to the predetermined movement amount (e.g. the distance between the center position and the valve opening position). Thus, the drive valve moves toward the center position due to the elastic force of the elastic member for attempting to hold the drive valve at the center position. The control device performs control such that electric power is supplied to the magnetic force generating device, when the position of the drive valve based on the movement amount becomes the center position. Thus, the electromagnetic force generated by the magnetic force generating device and an inertiforce are applied to the drive valve after the drive valve passes the center position. At this time, a resultant force of the electromagnetic forces is applied in the same direction as the direction in which the drive valve moves. Accordingly, the drive valve can be controlled to move to one of the first position and the second position (e.g. the valve closing position). It is, therefore, possible to provide the control unit for an electromagnetically driven valve which performs efficient control based on the structure of the electromagnetically driven valve.

The control device may perform control such that an amount of the electric power supplied to the magnetic force generating device becomes equal to a predetermined amount of electric power, when the movement amount becomes equal to the predetermined movement amount.

In this case, the amount of electric power required to keep the drive valve attracted at the valve opening position or the valve closing position is smaller than the amount of electric power supplied when the movement of the drive valve is controlled. Accordingly, for example, when the movement amount becomes equal to the predetermined movement amount corresponding to the valve opening position or the valve closing position, the amount of electric power supplied to the magnetic force generating device (e.g. the electromagnet) is set to the amount of electric power required to keep the drive valve attracted at the valve opening position or the valve closing position, whereby electric power consumption can be suppressed.

Electromagnetic force for stopping reciprocation of the drive valve may be applied to the drive valve by supplying the predetermined amount of electric power.

In this case, the electromagnetic force for stopping reciprocation of the drive valve is applied to the drive valve by supplying the predetermined amount of electric power. Since the amount of electric power required to keep the drive valve attracted to the valve opening position or the valve closing position is supplied in order to stop reciprocation of the drive valve, electric power consumption can be suppressed.

The magnetic force generating device may be an electromagnet formed of a piece of coil.

In this case, the magnetic force generating device is the electromagnet formed of a piece of coil, that is, a mono-coil. When the invention is applied to the electromagnetically driven valve using the electromagnet having such a structure, it is possible to perform efficient control based on the structure of the electromagnetically driven valve.

The electromagnetically driven valve may be a parallel link type electromagnetically driven valve.

In this case, since the invention is applied to the electromagnetically driven valve including the rotary driven type parallel link mechanism in which plural oscillation members are provided and the drive valve is reciprocated due to the oscillating movement of the oscillation members, it is possible to perform efficient control based on the structure of the electromagnetically driven valve.

BRIEF DESCRIPTION OF THE DRAWINGS

The features, advantages thereof, and technical and industrial significance of embodiments of the invention will be better understood by reading the following detailed description of exemplary embodiments, when considered in connection with the accompanying drawings, in which.

DETAILED DESCRIPTION OF THE EXEMPLARY EMBODIMENTS

Figure 1:
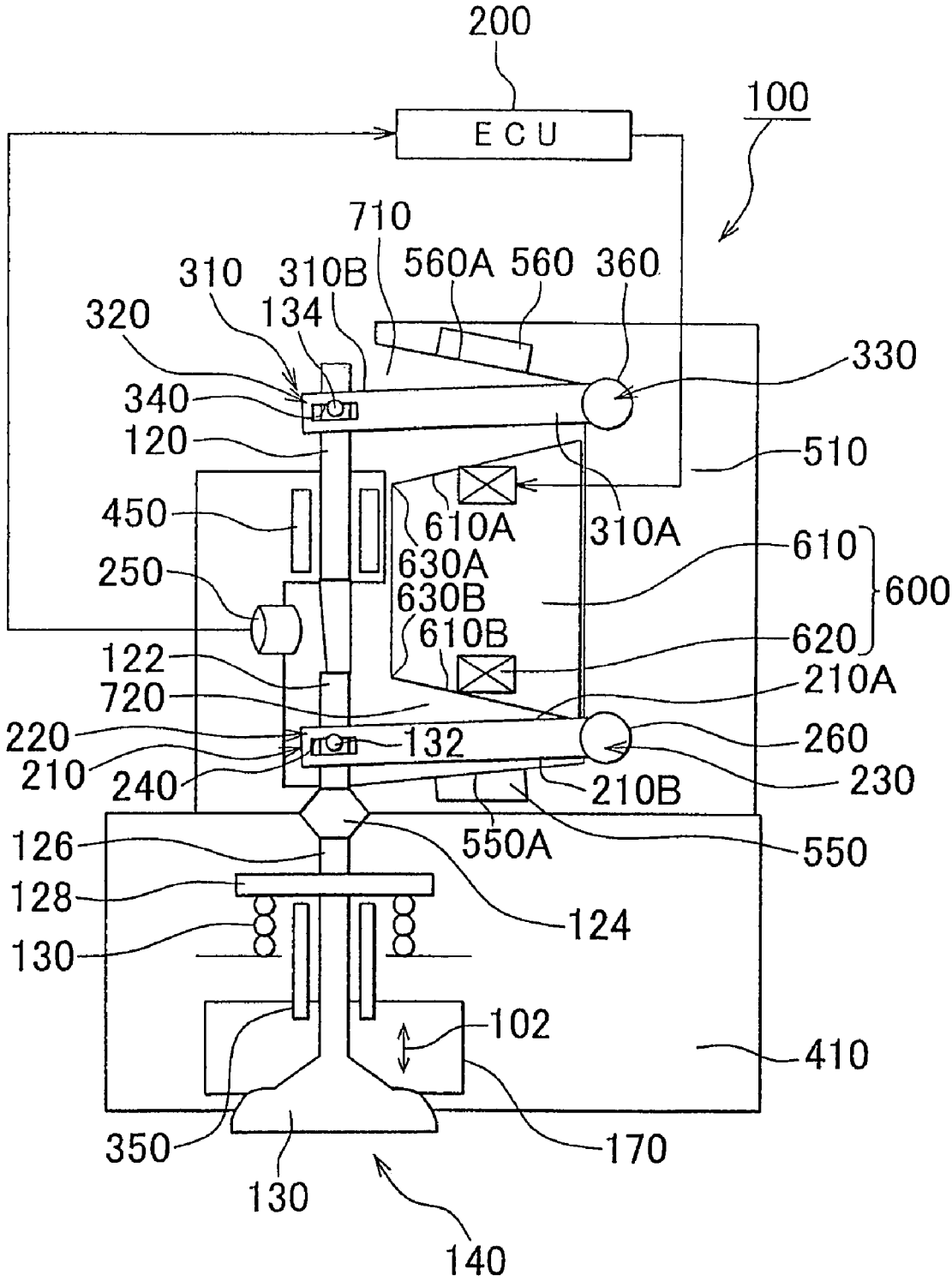
FIG. 1 illustrates a cross sectional view of an electromagnetically driven valve in a first embodiment of the invention.

In the following description and the accompanying drawings, the invention will be described in more detail in terms of exemplary embodiments. In the following description, the same reference numerals will be assigned to the same components. The components having the same reference numerals have the same names and the same functions. Accordingly, the detailed description concerning the components having the same reference numerals will be made only once.

A first embodiment of the invention will be described in detail. An electromagnetically driven valve 100 in the first embodiment forms an engine valve (an intake valve or an exhaust valve) of an internal combustion engine such as a gasoline engine or a diesel engine.

As shown in FIG. 1, the electromagnetically driven valve 100 in the first embodiment is a rotary driven type electromagnetically driven valve, and a parallel link mechanism is used as a motion mechanism of the electromagnetically driven valve 100. The electromagnetically driven valve 100 includes a drive valve 140 having a stem 120 extending in one direction; a lower disk 210 and an upper disk 310 which are connected to the stem 120 at different positions and which oscillate by using electromagnetic force and elastic force that are applied thereto; an open/close electromagnet 600 which generates the electromagnetic force (hereinafter, simply referred to as an "electromagnet 600"); and a lower spring 260 and an upper spring 360 each of which has the elastic force. The drive valve 140 reciprocates in the direction in which the stem 120 extends (the direction shown by an arrow 102) due to the oscillating movement of the lower disk 210 and the upper disk 310.

The drive valve 140 is provided in a cylinder head 410 in which an intake port 170 is formed. The drive valve 140 further includes a bell portion 130 formed at an end of the stem 120. As the drive valve 140 reciprocates, the bell portion 130 contacts the intake port 170 or moves away from the intake port 170, whereby the intake port 170 is closed or opened, respectively. More specifically, when the stem 120 moves upward, the drive valve 140 is moved to the valve closing position, and when the stem 120 moves downward, the drive valve 140 is moved to the valve opening position.

The stem 120 is formed of a lower stem 126 that extends from the bell portion 130, and an upper stem 122 that is connected to the lower stem 126 via a lash adjuster 124. The lash adjuster 124 serves a buffering member between the upper stem 122 and the lower stem 126, and is likely to stretch and unlikely to shrink. A connection pin 132, which protrudes from the outer surface of the upper stem 122, is provided for the upper stem 122. A connection pin 134, which protrudes from the outer surface of the upper stem 122, is provided for the upper stem 122 at a predetermined distance from the connection pin 132.

A valve guide 350 that slidably guides the lower stem 126 in the axial direction is provided in the cylinder head 410. A stem guide 450 that slidably guides the upper stem 122 in the axial direction is provided, at a position at a predetermined distance from the valve guide 350. The valve guide 350 and the stem guide 450 are made of metal material such as stainless so as to endure sliding with the stem 120 at a high speed.

In a disk base 510, a lift amount detection sensor 250 is provided so as to face the upper stem 122. The lift amount detection sensor 250 detects an amount of vertical movement of the upper stem 122. The lift amount detection sensor 250 is connected to an ECU (Electronic Control Unit) 200, and a signal indicating the detected amount of vertical movement is transmitted to the ECU 200. The lift amount detection sensor 250 is not particularly limited to a certain type of sensor, as long as the sensor can detect an amount of vertical movement of the upper stem 122. For example, a sensor which optically detects the amount of movement of the upper stem 122 may be used.

Figure 2:
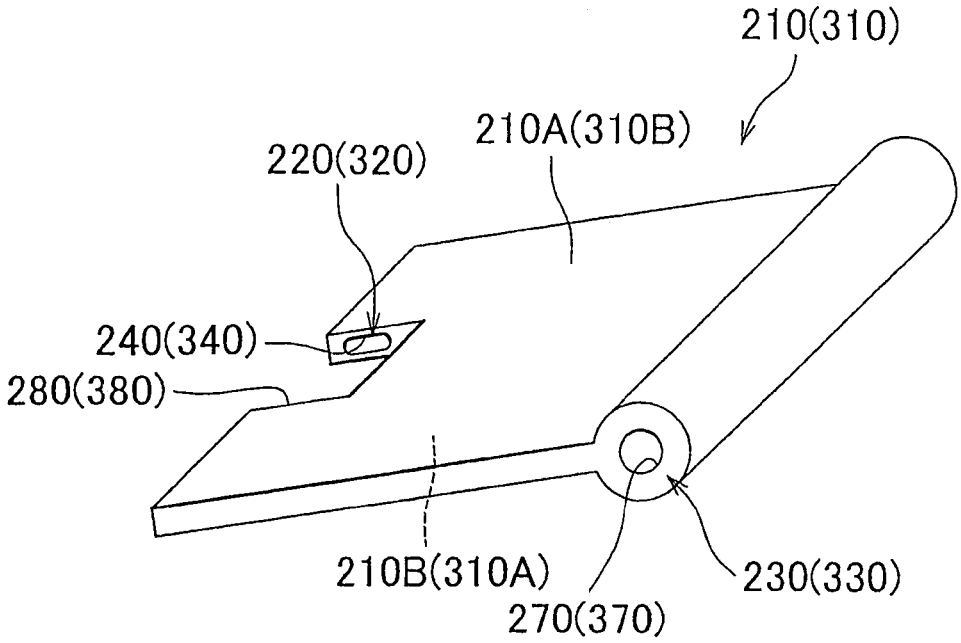
FIG. 2 illustrates a perspective view of a lower disk (an upper disk) in FIG. 1.

As shown in FIG. 2, the lower disk 210 has a first end 220 and a second end 230, and extends from the first end 220 toward the second end 230 in the direction that crosses the direction in which the stem 120 extends. The lower disk 210 includes a flat plate shaped portion having rectangular surfaces 210A and 210B, in the first end 220 side. Also, the lower disk 210 includes a hollow cylindrical portion in which a hole 270 is formed, in the second end 230 side. A notched portion 280 is formed in the lower disk 210 in the first end 220 side, and a long hole 240 is formed in each of wall surfaces of the notched portion 280, which face each other.

The upper disk 310 has the same shape as that of the lower disk 210. In the upper disk 310, a first end 320, a second end 330, a surface 310B, a surface 310A, a hole 370, a notched portion 380, and a long hole 340 are formed, which correspond to the first end 220, the second end 230, the surface 210A, the surface 210B, the hole 270, the notched portion 280, and the long hole 240 in the lower disk 210, respectively. The lower disk 210 and the upper disk 310 are made of soft magnetic material.

Figure 4:
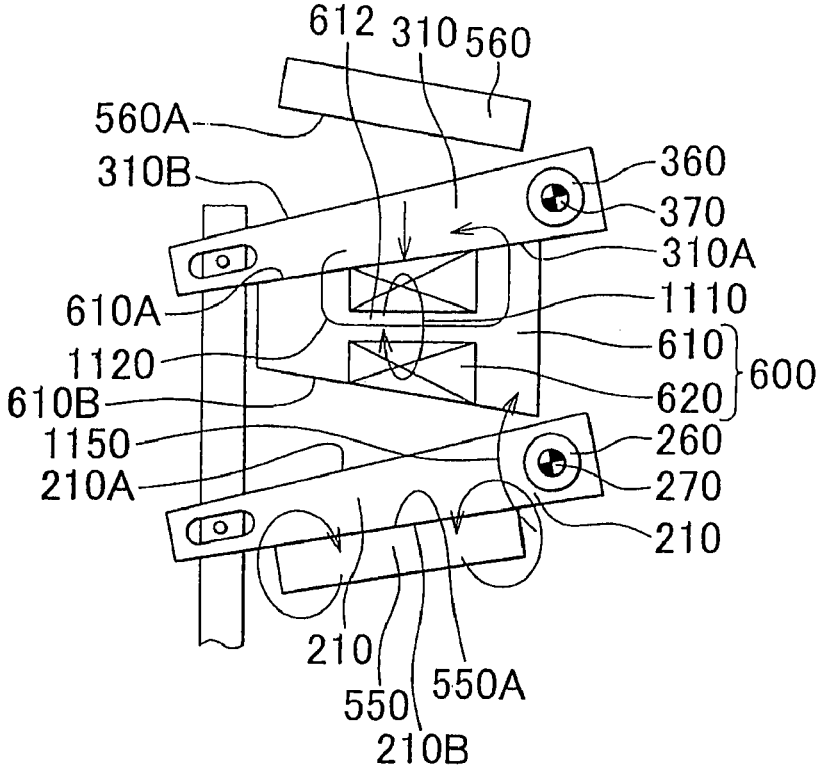
FIG. 4 illustrates a schematic view of the upper disk and the lower disk that have been displaced to the fullest extent so that the valve is opened.
Figure 5:
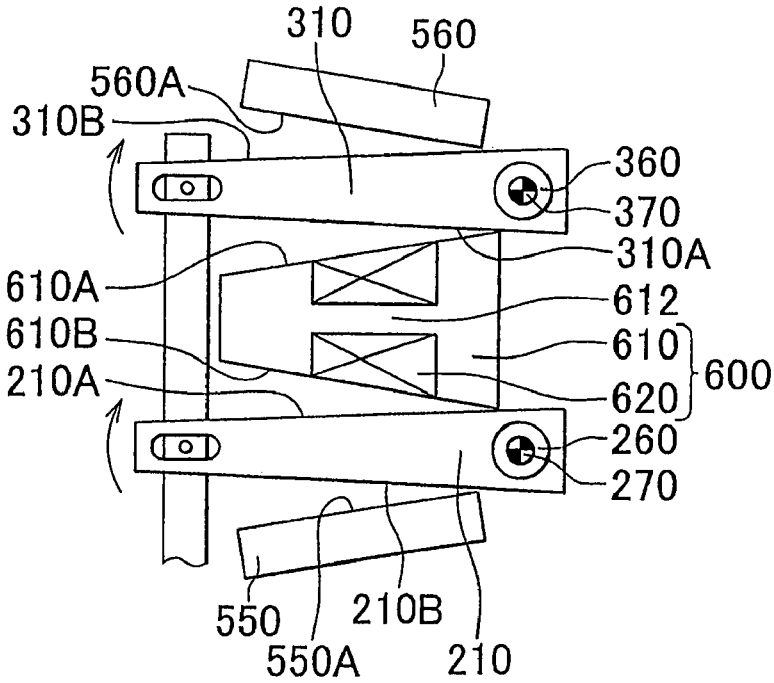
FIG. 5 illustrates a schematic view of the upper disk and the lower disk that are at the center position.
Figure 6:
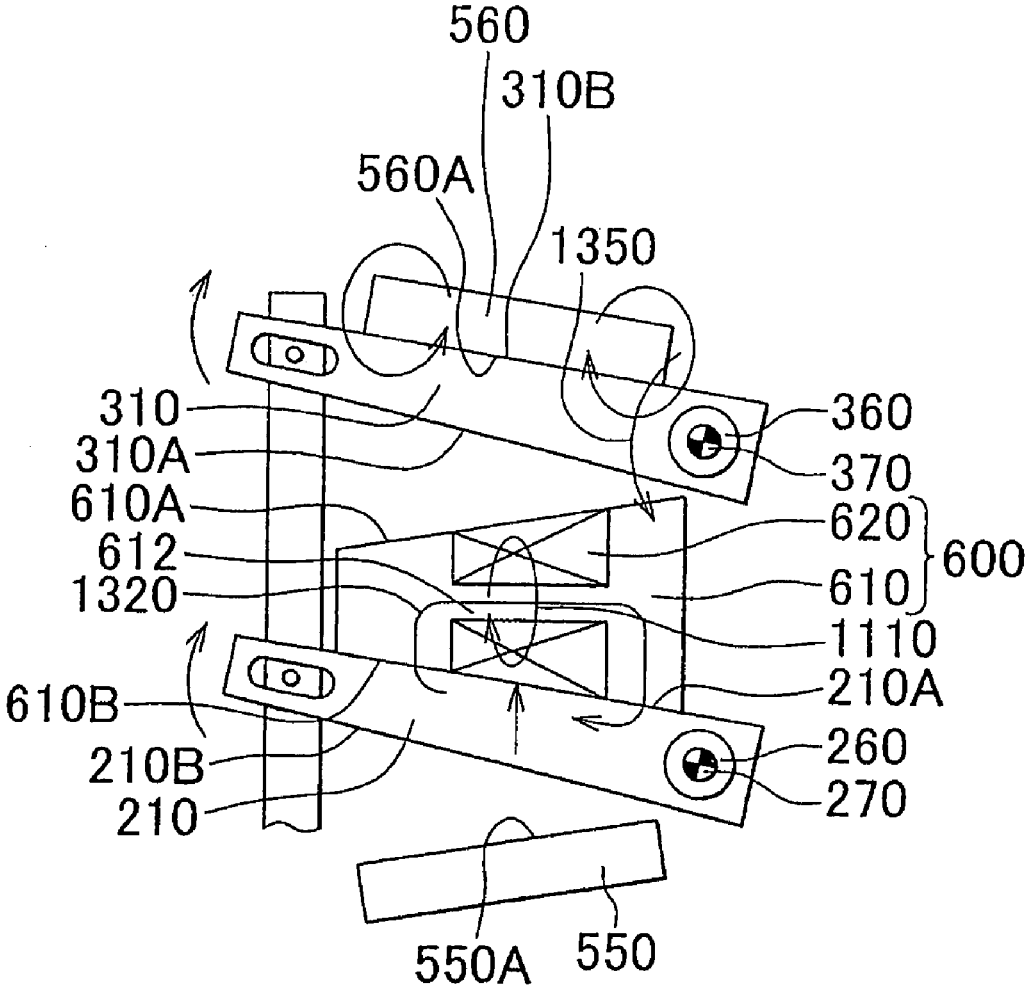
FIG. 6 illustrates a schematic view of the upper disk and the lower disk that have been displaced to the fullest extent so that the valve is closed.

The first end 220 of the lower disk 210 is movably connected to the upper stem 122 when the connection pin 132 is inserted into the long holes 240. Similarly, the first end 320 of the upper disk 310 is movably connected to the upper stem 122 when the connection pin 134 is inserted into the long holes 340. The disk base 510 extending in parallel with the stem 120 is provided on the top surface of the cylinder head 410. The second end 230 of the lower disk 210 is supported by the disk base 510 such that the lower disk 210 can oscillate with respect to the supporting point 270 in the disk base 510, as shown in FIGS. 4, 5, and 6. Similarly, the second end 330 of the upper disk 310 is supported by the disk base 510 such that the upper disk 310 can oscillate with respect to the supporting point 370 in the disk base 510, as shown in FIGS. 4, 5, and 6. With such a structure, the drive valve 140 can be reciprocated by oscillating the lower disk 210 with respect to the supporting point 270, and the upper disk 310 with respect to the supporting point 370.

The lower spring 260 is provided in the second end 230 of the lower disk 210, and the upper spring 360 is provided in the second end 330 of the upper disk 310. The lower spring 260 applies elastic force to the lower disk 210 in the clockwise direction around the supporting point 270. The upper spring 360 applies elastic force to the upper disk 310 in the counterclockwise direction around the supporting point 370. In the state where electromagnetic force is not applied by the aftermentioned electromagnet 600, the lower disk 210 and the upper disk 310 are placed at the center position by the lower spring 260 and the upper spring 360. The center position is between the position, at which the lower disk 210 and the upper disk 310 have been displaced to the fullest extent so that the valve is opened, and the position, at which the lower disk 210 and the upper disk 310 have been displaced to the fullest extent so that the valve is closed.

Figure 3:
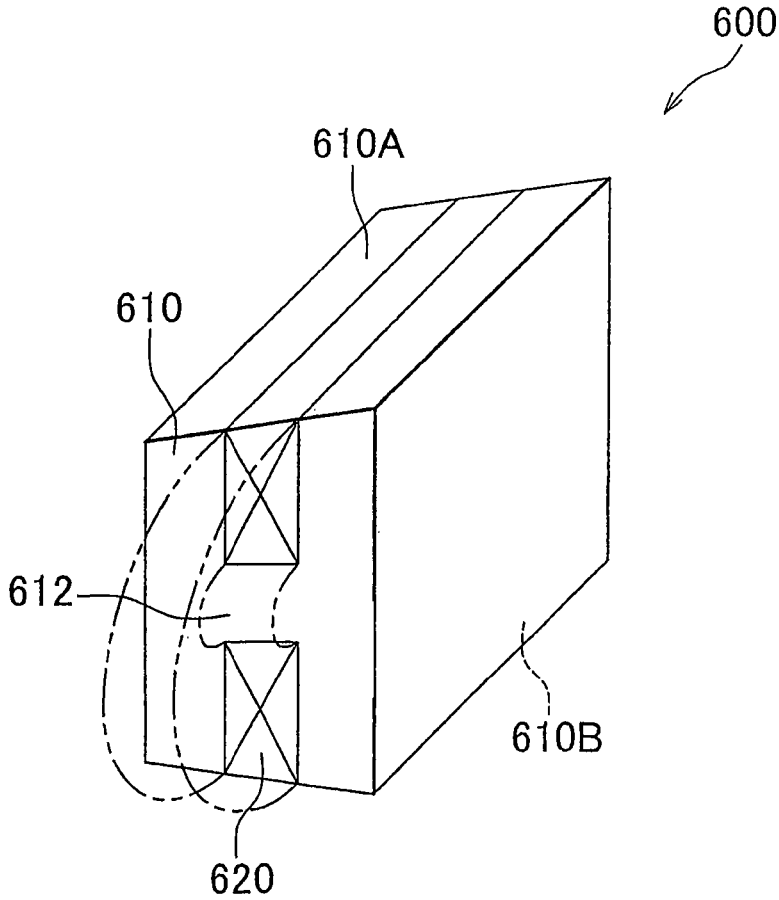
FIG. 3 illustrates a view of an electromagnet in FIG. 1.

As shown in FIG. 1 and FIG. 3, the disk base 510 is provided with the electromagnet 600 such that the electromagnet 600 is positioned between the lower disk 210 and the upper disk 310. The electromagnet 600 includes an open/close coil 620, and an open/close core 610 which is made of magnetic material and which has an attraction surface 610A facing the surface 310A of the upper disk 310, and an attraction surface 610B facing the surface 210A of the lower disk 210. The open/close core 610 has a shaft portion 612 that extends in a direction from the first end toward the second end of the lower disk 210 or the upper disk 310. The open/close coil 620 is provided so as to be wound around the shaft portion 612. The open/close coil 620 is formed of a mono-coil.

The disk base 510 further includes a valve opening permanent magnet 550, and a valve closing permanent magnet 560 that is opposed to the valve opening permanent magnet 550 with the electromagnet 600 interposed therebetween. The valve opening permanent magnet 550 has an attraction surface 550A that faces the surface 210B of the lower disk 210. A space 720 in which the lower disk 210 oscillates is defined between the attraction surface 550A and the attraction surface 610B of the electromagnet 600. The valve closing permanent magnet 560 has an attraction surface 560A that faces the surface 310B of the upper disk 310. A space 710 in which the upper disk 310 oscillates is defined between the attraction surface 560A and the attraction surface 610A of the electromagnet 600.

As shown in FIG. 4, when the drive valve 140 is at the valve opening position, an electric current, which flows around the shaft portion 612 of the open/close core 610 in the direction shown by an arrow 1110, is supplied to the open/close coil 620. At this time, the electric current flows in a circular path from the rear to the front as viewed in FIG. 4 and back again. Accordingly, on the side of the upper disk 310, the electric current flows from the rear to the front as viewed in FIG. 4. Thus, a magnetic flux flows in the open/close core 610 in a direction shown by an arrow 1120, whereby electromagnetic force for attracting the upper disk 310 to the attraction surface 610A of the electromagnet 600 is generated. Meanwhile, the lower disk 210 is attracted to the attraction surface 550A by the valve opening permanent magnet 550. As a result, as shown in FIG. 4, the upper disk 310 and the lower disk 210 are displaced to the fullest extent so that the valve is opened, and maintained in this state against the elastic force of the lower spring 260 provided around the supporting point 270.

Next, when the supply of an electric current (i.e., electric power) to the open/close coil 620 is stopped, the electromagnetic force generated by the electromagnet 600 disappears. Thus, as shown in FIG. 5, the upper disk 310 and the lower disk 210 move away from the attraction surfaces 610A and 550A, respectively, due to the elastic force of the lower spring 260, and start to oscillate toward the center position. The elastic force of the lower spring 260 and the upper spring 360 attempts to hold the upper disk 310 and the lower disk 210 at the center position. Accordingly, when the upper disk 310 and the lower disk 210 oscillate and exceed the center position, force is applied to the upper disk 310 and the lower disk 210 by the upper spring 360 in the direction opposite to the direction in which the upper disk 310 and the lower disk 210 oscillate. However, since an inertiforce is applied to the upper disk 310 and the lower disk 210 in the direction in which the upper disk 310 and the lower disk 210 oscillate, the upper disk 310 and the lower disk 210 oscillate and exceed the center position.

Next, an electric current is supplied to the open/close coil 620 again in the direction shown by the arrow 1110, when the upper disk 310 and the lower disk 210 exceed the center position. At this time, the electric current flows in a circular path from the front to the rear as viewed in FIG. 6 and back again. Accordingly, on the side of the lower disk 210, the electric current flows from the front to the rear as viewed in FIG. 6. Thus, a magnetic flux flows in the open/close core 610 in the direction shown by an arrow 1320, whereby electromagnetic force for attracting the lower disk 210 to the attraction surface 610B of the electromagnet 600 is generated. Meanwhile, the upper disk 310 is attracted to the attraction surface 560A by the valve closing permanent magnet 560.

At this time, the upper disk 310 is attracted to the attraction surface 610A of the electromagnet 600 due to electromagnetic force generated by the electromagnet 600. However, the electromagnetic force acts more strongly as the distance between the lower disk 210 and the electromagnet 600 becomes smaller. Accordingly, the upper disk 310 and the lower disk 210 that have exceeded the center position are displaced to the fullest extent so that the valve is closed, as shown in FIG. 6.

Then, the supply of the electric current to the open/close coil 620 is repeatedly started and stopped at the above-mentioned timing. Thus, the upper disk 310 and the lower disk 210 are oscillated so as to be repeatedly displaced to the fullest extent so that the valve is opened and displaced to the fullest extent so that the valve is closed. The drive valve 140 can be reciprocated due to this oscillating movement. Starting and stopping the supply of an electric current to the open/close coil 620, and an amount of electric current supplied to the open/close coil 620 are controlled by the ECU 200 that is the control unit for an electromagnetically driven valve 100 according to the first embodiment.

Here, initial driving of the drive valve 140 from the center position will be described. The upper disk 310 and the lower disk 210 are held at substantially the center position by the upper spring 360 and the lower spring 260. Accordingly, when the engine is started, the drive valve 140 needs to be moved to the valve opening position or the valve closing position. For example, in the case of an intake valve, the engine is started when the drive valve 140 is at the valve closing position. On the other hand, in the case of an exhaust valve, the engine is started when the drive valve 140 is at the valve opening position.

The control unit for an electromagnetically driven valve according to the first embodiment performs control such that the drive valve 140 is moved to the valve opening position or the valve closing position when the drive valve 140 is initially driven from the center position. Namely, the ECU 200 that is the control unit for an electromagnetically driven valve according to the first embodiment controls an electric current supply period and an electric current supply stopped period according to an oscillation cycle T based on the elastic force of the upper spring 360 and the lower spring 260.

A movable portion formed of the upper disk 310, the lower disk 210, and the stem 120 is held at a predetermined position by the elastic force of the upper spring 360 and the lower spring 260. In the first embodiment, the "predetermined position" is a position that is slightly below the center position that is the midpoint between the valve opening position and the valve closing position. Since the movable portion performs a simple harmonic oscillation, a natural oscillation cycle T can be calculated based on a mass of the movable portion, and a total spring constant of the upper spring 360 and the lower spring 260.

If an electric current is supplied to the open/close coil 620 when the movable portion is at the center position, electromagnetic force for opening the valve is applied to the movable portion, and also electromagnetic force for closing the valve, which is equal to the electromagnetic force for opening the valve, is applied to the movable portion. Namely, a resultant force of the electromagnetic forces applied to the movable portion becomes zero. Before driving of the drive valve 140 is started, since the lash adjuster 124 has been shrunk to the bottom position, the movable portion is held at a position slightly below the center position. Accordingly, when an electric current is supplied to the open/close coil 620, force is applied to the stem 120 in the downward direction as viewed in FIG. 1, that is, the direction in which the valve is opened.

An electric current is supplied to the open/close coil 620 for a period of T/4 in order to cause a self-excited oscillation by using the upper spring 360, the lower spring 260, and a simple harmonic oscillation of the movable portion. Then, the supply of an electric current to the open/close coil 620 is stopped for the subsequent period of T/4 in order to use a restoring force of the upper spring 360 and the lower spring 260.

Figure 7:
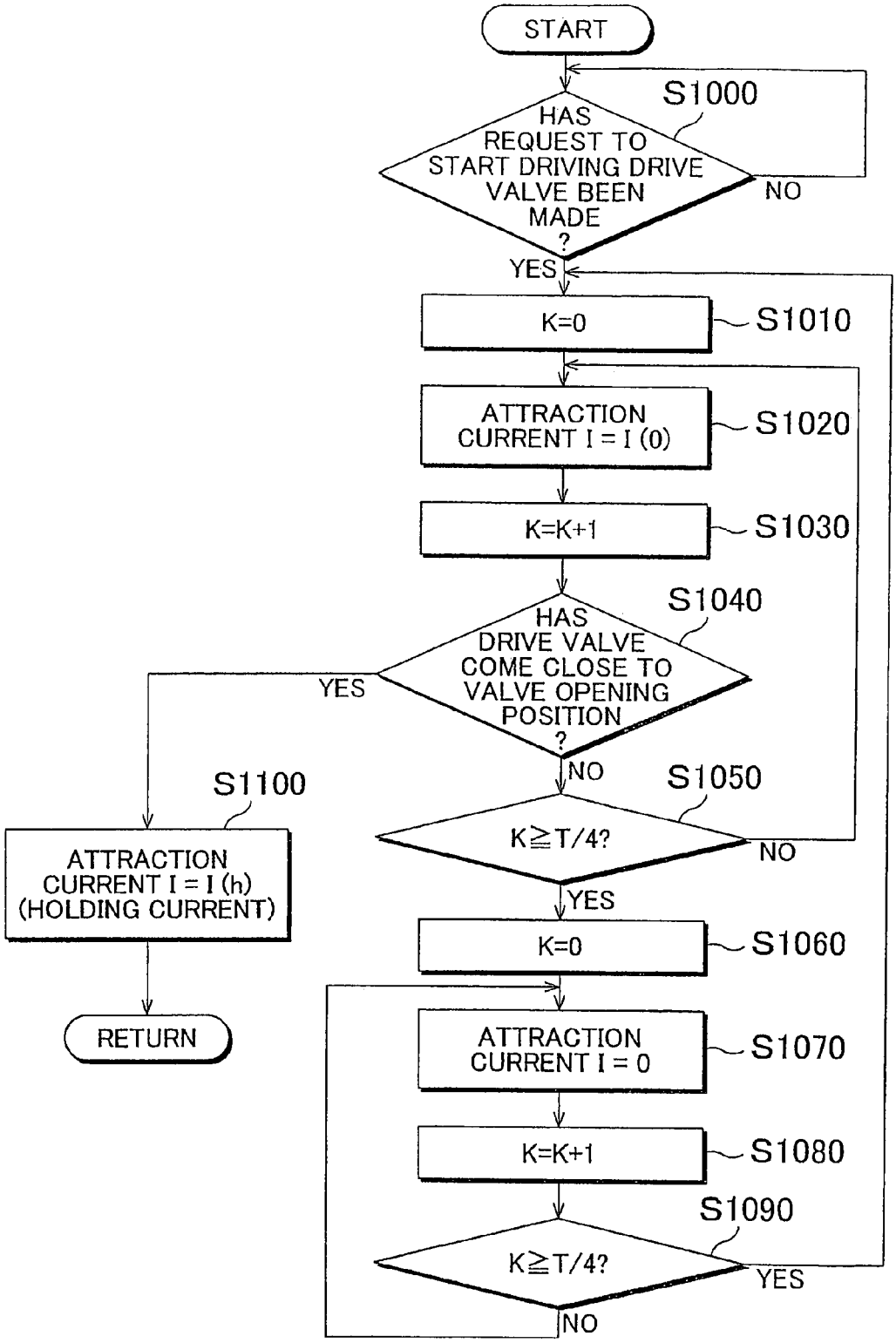
FIG. 7 illustrates a flowchart of a control structure of a program performed by an ECU that is a control unit for an electromagnetically driven valve according to the first embodiment.

With reference to FIG. 7, a description will be made concerning a control structure of a program performed by the ECU 200 that is the control unit for an electromagnetically driven valve according to the first embodiment.

In step S1000, the ECU 200 determines whether a request to start driving the drive valve 140 has been made. An example of a state where a request to start driving the drive valve 140 has been made is a state where a driver operates an IG switch so that the engine can be started. However, the state where a request to start driving the drive valve 140 is not particularly limited. When it is determined that a request to start driving the drive valve 140 has been made ("YES" in step S1000), step S1010 is performed. On the other hand, when it is determined that a request to start driving the drive valve 140 has not been made ("NO" in step S1000), the ECU 200 is placed in a standby mode until a request to start driving the drive valve 140 is made.

In step S1010, the ECU 200 replaces a value K with "0", that is, starts time-measurement using a timer. In step S1020, the ECU 200 performs control such that an electric current I (0) is supplied to the open/close coil 620. The electric current I (0) is not particularly limited. Note that, the electric current I (0) is, for example, an electric current for generating electromagnetic force required to cause the movable portion to perform a self-excited oscillation. In step S1030, the ECU 200 sets the value K to a value obtained by adding "1" to the value K.

In step S1040, the ECU 200 determines whether the drive valve 140 has come close to the valve opening position. Whether the drive valve 140 has come close to the valve opening position is determined based on a coordinate point indicating the position of the drive valve 140, the coordinate point corresponding to a movement amount of the drive valve 140 detected by the lift amount detection sensor 250. Namely, when the coordinate point corresponding to the detected movement amount of the drive valve 140 is lower than a predetermined value −X (0) that is close to the valve opening position, it is determined that the drive valve 140 has come close to the valve opening position. When it is determined that the drive valve 140 has come close to the valve opening position ("YES" in step S1040), step S1100 is performed. On the other hand, when it is determined that the drive valve 140 has not come close to the valve opening position ("NO" in step S1040), step S1050 is performed.

In step S1050, the ECU 200 determines whether the valve K is equal to or larger than T/4. When it is determined that the value K is equal to or larger than T/4 ("YES" in step S1050), step S1060 is performed. On the other hand, when it is determined that the value K is smaller than T/4 ("NO" in step S1050), step S1020 is performed.

In step S1060, the ECU 200 replaces the value K with "0", that is, starts time-measurement using the timer. In step S1070, the ECU 200 performs control such that the supply of an electric current to the open/close coil 620 is stopped. In step S1080, the ECU 200 sets the value K to a value obtained by adding "1" to the value K. In step S1090, the ECU 200 determines whether the value K is equal to or larger than T/4. When it is determined that the value K is equal to or larger than T/4 ("YES" in step S1090), step S1010 is performed. On the other hand, when it is determined that the value K is smaller than T/4 ("NO" in step S1090), step S1070 is performed. In step S1100, the ECU 200 performs control such that an electric current I (h) is supplied to the open/close coil 620. The electric current I (h) is not particularly limited, as long as the electric current I (h) is a current value at which an amount of electric power required to stop reciprocation of the drive valve 140 and keep the reciprocation of the drive valve 140 stopped can be supplied.

An operation of the ECU 200 that is the control unit for an electromagnetically driven valve according to the first embodiment based on the above-mentioned structure and flowchart will be described with reference to FIG. 8. In the first embodiment, a description is made on the assumption that the electromagnetically driven valve 100 is an exhaust valve. Namely, when a request to start driving the drive valve 140 has been made, the ECU 200 performs control such that the drive valve 140 moves to the valve opening position. In the case where the electromagnetically driven valve 100 is used as an intake valve, when a request to start driving the drive valve 140 has been made, the ECU 200 performs control such that the drive valve 140 moves to the valve closing position.

Figure 8:
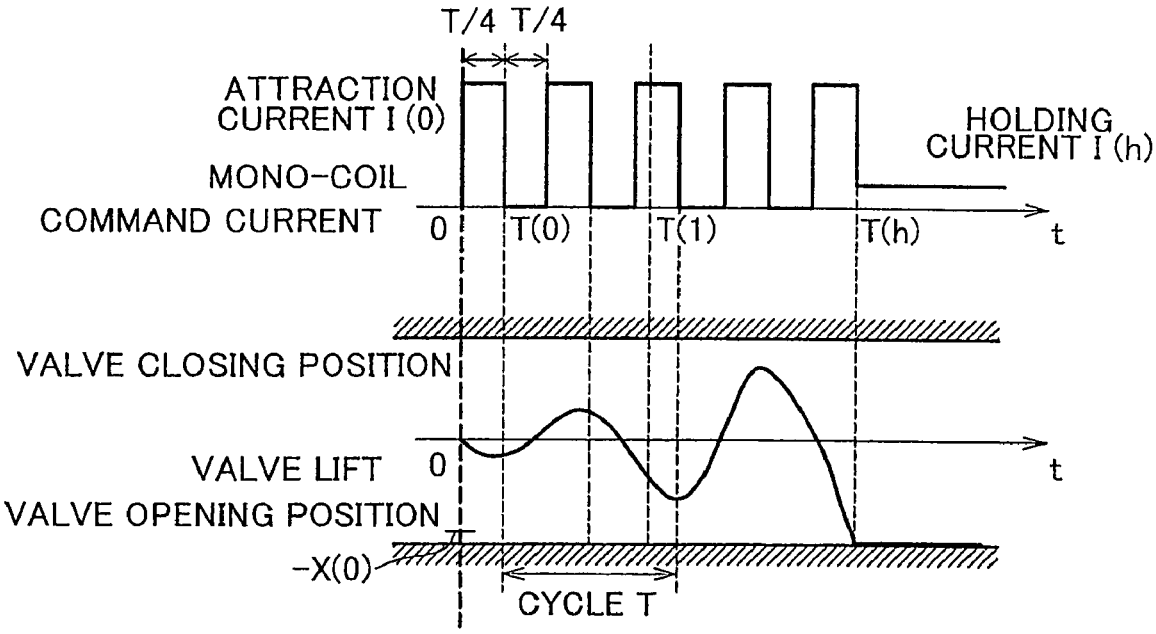
FIG. 8 illustrates a timing chart showing an operation of the electromagnetically driven valve controlled by the ECU that is the control unit for an electromagnetically driven valve according to the first embodiment.

As shown in a graph on the upper side in FIG. 8, when a request to start driving the drive valve 140 is detected at time "t=0" ("YES" in step S1000), the time-measurement using the timer is started in step S1010, and the attraction current I (0) is supplied to the open/close coil 620 in step S1020. When it is determined that the drive valve 140 has not come close to the valve opening position ("NO" in step S1040), the attraction current I (0) is supplied to the open/close coil 620 in step S1020 while the period of T/4 has not elapsed ("NO" in steps S1040 and S1050). At this time, since the drive valve 140 is held at a position slightly below the center position, electromagnetic force is applied in the direction in which the valve is opened. When the period of T/4 has elapsed ("YES" in step S1050), the time-measurement is restarted in step S1060, and the supply of an electric current to the open/close coil 620 is stopped in step S1070. The supply of an electric current to the open/close coil 620 is stopped while the period of T/4 has not elapsed ("NO" in steps S1080 and S1090).

When the supply of an electric current to the open/close coil 620 is stopped at time "t=T (0)", as shown in a graph on the lower side in FIG. 8, the coordinate point indicating the position of the drive valve 140 is close to the extreme value. Accordingly, if the supply of an electric current to the open/close coil 620 is stopped, electromagnetic force is not applied to the drive valve 140, and only the elastic force of the upper spring 360 and the lower spring 260 for attempting to hold the drive valve 140 at the center position is applied to the drive valve 140. A time-change-rate (a movement speed) of the drive valve 140 increases as the drive valve 140 moves toward the center position. When the period of T/4 has elapsed ("YES" in step S1090), an electric current is supplied to the open/close coil 620 again. When the drive valve 140 is near the center position and the position of the drive valve 140 is on the valve opening side with respect to the center position at "time t=T (1)", a resultant force of an inertiforce, force for returning the drive valve 140 to the center position by using elastic force, and electromagnetic force applied in the direction in which the drive valve 140 moves is applied to the drive valve 140. The extreme value of the movement amount of the drive valve 140 is gradually increased by repeatedly supplying an electric current to the open/close coil 620 during the period of T/4 and stopping the supply of an electric current to the open/close coil 620 during the period of T/4. When the coordinate point corresponding to the movement amount of the drive valve 140 becomes lower than the predetermined value −X (0) ("YES" in step S1040), the electric current I (h) is supplied to the open/close coil 620 at time "t=T (h)". Thus, electromagnetic force for stopping the reciprocation of the drive valve 140 is applied to the drive valve 140.

As described so far, with the control unit for an electromagnetically driven valve 100 according to the first embodiment, an electric current is supplied to the open/close coil 620, and the ECU 200 controls the electric current supply period and the electric current supply stopped period according to the oscillation cycle T based on the elastic force. The period of T/4, which corresponds to a period from when the drive valve 140 starts moving from the center position until when the drive valve 140 reaches the position corresponding to the extreme value of the movement amount of the drive valve 140, is the electric current supply period in which an electric current is supplied to the electromagnet 600. The subsequent period of T/4, which corresponds to a period from when the drive valve 140 starts moving from the position corresponding to the extreme value of the movement amount of the drive valve 140 until when the drive valve 140 reaches the center position, is the electric current supply stopped period in which the supply of an electric current to the electromagnet 600 is stopped. In this case, since the drive valve 140 is held at a position slightly below the center position, in the first electric current supply period of T/4, the drive valve 140 is attracted by electromagnetic force generated by the electromagnet 600, and moves downward from the center position. In the electric current supply stopped period of T/4, electromagnetic force is not applied to the drive valve 140. Therefore, force for returning the drive valve 140 to the center position is applied to the drive valve 140 due to the elastic force of upper spring 360 and the lower spring 260. Then, an electric current is supplied again after the period of T/4 from when the supply of an electric current is stopped until when the drive valve 140 is returned to the center position has elapsed. Accordingly, the drive valve 140 moves upward due to an inertiforce and electromagnetic force. The extreme value of the movement amount of the drive valve 140 can be increased by repeatedly supplying an electric current to the open/close coil 620 during the period of T/4 and stopping the supply of an electric current to the open/close coil 620 during the period of T/4 in the above-mentioned manner. Accordingly, the drive valve 140 can be moved to a desired position from among the valve opening position and the valve closing position. Since supplying the electric current to the open/close coil 620 during the period of T/4 and stopping the supply of the electric current to the open/close coil 620 during the period of T/4 are repeated, electric power consumption can be suppressed. It is, therefore, possible to provide the control unit for an electromagnetically driven valve that performs efficient control depending on the structure of the electromagnetically driven valve.

Hereafter, a control unit for an electromagnetically driven valve according to a second embodiment will be described. The electromagnetically driven valve in the second embodiment has the same structure as that of the electromagnetically driven valve 100 in the first embodiment. The same reference numerals are assigned to the same components. The components having the same reference numerals have the same functions. Accordingly, the detailed description concerning the components having the same reference numerals as those in the first embodiment will not be made here.

The control unit for an electromagnetically driven valve according to the second embodiment is the same as the control unit for an electromagnetically driven valve 100 according to the first embodiment except for a control structure of a program performed by the ECU 200.

The ECU 200 that is the control unit for an electromagnetically driven valve according to the second embodiment performs control so as to supply an electric current to the open/close coil 620 in a manner in which supplying electric current to the open/close coil 620 during the period of T/4 and stopping the supply of the electric current to the open/close coil 620 during the period of T/4 are repeated in the first period of oscillation cycle T of the movable portion, as in the case of the first embodiment. The ECU 200 then causes the movable portion to perform a self-excited oscillation. Then, the ECU 200 determines whether a coordinate point corresponding to a movement amount "x" of the drive valve 140 detected by the lift amount detection sensor 250 is in a predetermined range (e.g. a range from a lower limit −Δx to an upper limit Δx). When it is determined that the coordinate point corresponding to the movement amount "x" is changed from a value in the predetermined range to a value outside the predetermined range, the ECU 200 performs control such that an electric current is supplied to the open/close coil 620. Then, the ECU 200 determines whether the coordinate point corresponding to a time-change-rate (a movement speed) v of the movement amount based on the detected movement amount "x" is in a predetermined range (e.g. a range from a lower limit −Δv to an upper limit Δv). When it is determined that the time-change-rate "v" is changed from a value outside the predetermined range to a value in the predetermined range, the ECU 200 performs control such that the supply of an electric current to the open/close coil 620 is stopped. The predetermined range may be set such that the difference between the upper limit and "0" is different from the difference between the lower limit and "0".

Figure 9:
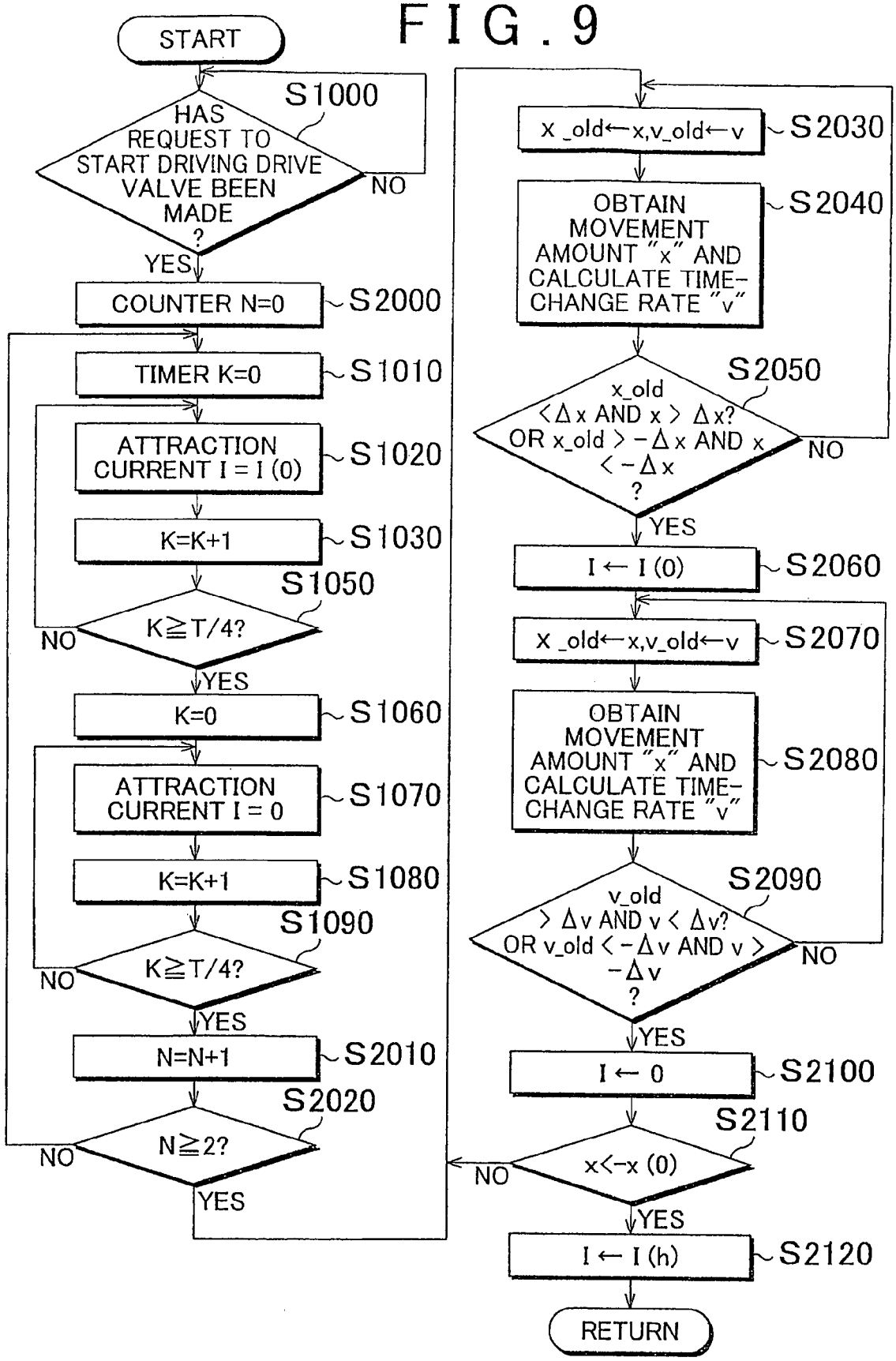
FIG. 9 illustrates a flowchart of a control structure of a program performed by an ECU that is a control unit for an electromagnetically driven valve according to a second embodiment of the invention.

Hereafter, a control structure of a program performed by the ECU 200 that is the control unit for an electromagnetically driven valve according to the second embodiment will be described with reference to FIG. 9. In a flowchart in FIG. 9, the same reference numerals are assigned to the same steps as those in the flowchart in FIG. 7. The processes in the steps having the same reference numerals are also the same. Accordingly, the detailed description concerning the steps having the same reference numerals will not be made here.

In step S2000, the ECU 200 replaces a value N with "0". Namely, counting using a counter is started. In step S2010, the ECU 200 sets the value N to a value obtained by adding "1" to the value N. In step S2020, the ECU 200 determines whether the value N is equal to or larger than "2". When it is determined that the value N is equal to or larger than "2" ("YES" in step S2020), step S2030 is performed. On the other hand, when it is determined that the value N is smaller than "2" ("NO" in step S2020), step S1010 is performed.

In step S2030, the ECU 200 regards the movement amount "x" stored in the memory of ECU 200 as a previous movement amount x_old. Similarly, the ECU 200 regards the time-change-rate (the movement speed) v of the movement amount stored in memory of the ECU 200 as a previous time-change-rate v_old.

In step S2040, the ECU 200 obtains a movement amount "x" of the drive valve 140 based on a detection signal transmitted from the lift amount detection sensor 250. The ECU 200 then calculates a time-change-rate "v" of the movement amount based on the movement amount "x".

In step S2050, the ECU 200 determines whether the coordinate point corresponding to the previous movement amount x_old is lower than the upper limit Δx and the coordinate point corresponding to the movement amount "x" is higher than the upper limit Δx. Also, the ECU 200 determines whether the coordinate point corresponding to the previous movement amount x_old is higher than the lower limit −Δx and the coordinate point corresponding to the movement amount "x" is lower than the lower limit −Δx. Namely, the ECU 200 determines whether the coordinate point corresponding to the movement amount of the drive valve 140 is changed from a value in the predetermined range (from the lower limit −Δx to the upper limit Δx) to a value outside the predetermined range. When the coordinate point corresponding to the previous movement amount x_old is lower than the upper limit Δx and the coordinate point corresponding to the movement amount "x" is higher than the upper limit Δx, or when the coordinate point corresponding to the previous movement amount x_old is higher than the lower limit −Δx and the coordinate point corresponding to the movement amount "x" is lower than the lower limit −Δx ("YES" in step S2050), step S2060 is performed. If not ("NO" in step S2050), step S2030 is performed.

In step S2060, the ECU 200 performs control such that the electric current I (0) is supplied to the open/close coil 620. In step S2070, the ECU 200 regards the movement amount "x" stored in the memory of the ECU 200 as a previous movement amount x_old. Similarly, the ECU 200 regards the time-change-rate (the movement speed) v of the movement amount stored in memory of the ECU 200 as a previous time-change-rate v_old. In step S2080, the ECU 200 obtains the movement amount "x" of the drive valve 140 based on a detection signal transmitted from the lift amount detection sensor 250. The ECU 200 then calculates the time-change-rate (the movement speed) v based on the movement amount "x".

In step S2090, the ECU 200 determines whether the coordinate point corresponding to the previous time-change-rate v_old is higher than the upper limit Δv and the coordinate point corresponding to the time-change-rate "v" is lower than the upper limit Δv. Also, the ECU 200 determines whether the coordinate point corresponding to the previous time-change-rate v_old is lower than the lower limit −Δv and the coordinate point corresponding to the time-change-rate "v" is higher than the lower limit −Δv. Namely, the ECU 200 determines whether the coordinate point corresponding to the time-change-rate of the movement amount of the drive valve 140 is changed from a value outside the predetermined range (the range from the lower limit −Δv to the upper limit Δv) to a value in the predetermined range. When it is determined that the coordinate point corresponding to the previous time-change-rate v_old is higher than the upper limit Δv and the coordinate point corresponding to the time-change-rate "v" is lower than the upper limit Δv, or when it is determined that the coordinate point corresponding to the previous time-change-rate v_old is lower than the lower limit −Δv and the coordinate point corresponding to the time-change-rate "v" is higher than the lower limit −Δv ("YES" in step S2090), step S2100 is performed. If not ("NO" in step S2090), step S2070 is performed.

In step S2100, the ECU 200 performs control such that the supply of an electric current to the open/close coil 620 is stopped. In step S2110, the ECU 200 determines whether the coordinate point corresponding to the movement amount "x" detected by the lift amount detection sensor 250 is lower than the predetermined value −X (0). When it is determined that the coordinate point corresponding to the movement amount "x" is lower than the predetermined value −X (0) ("YES" in step S2110), step S2120 is performed. If not ("NO" in step S2110), step S2030 is performed. In step S2120, the ECU 200 performs control such that the holding current I (h) is supplied to the open/close coil 620.

An operation of the control unit for an electromagnetically driven valve according to the second embodiment based on the above-mentioned structure and flowchart will be described with reference to FIG. 10. In the second embodiment, a description will be made on the assumption that the electromagnetically driven valve 100 is an exhaust valve. Namely, when a request to start driving the drive valve 140 has been made, the ECU 200 performs control such that the drive valve 140 is moved to the valve opening position.

Figure 10:
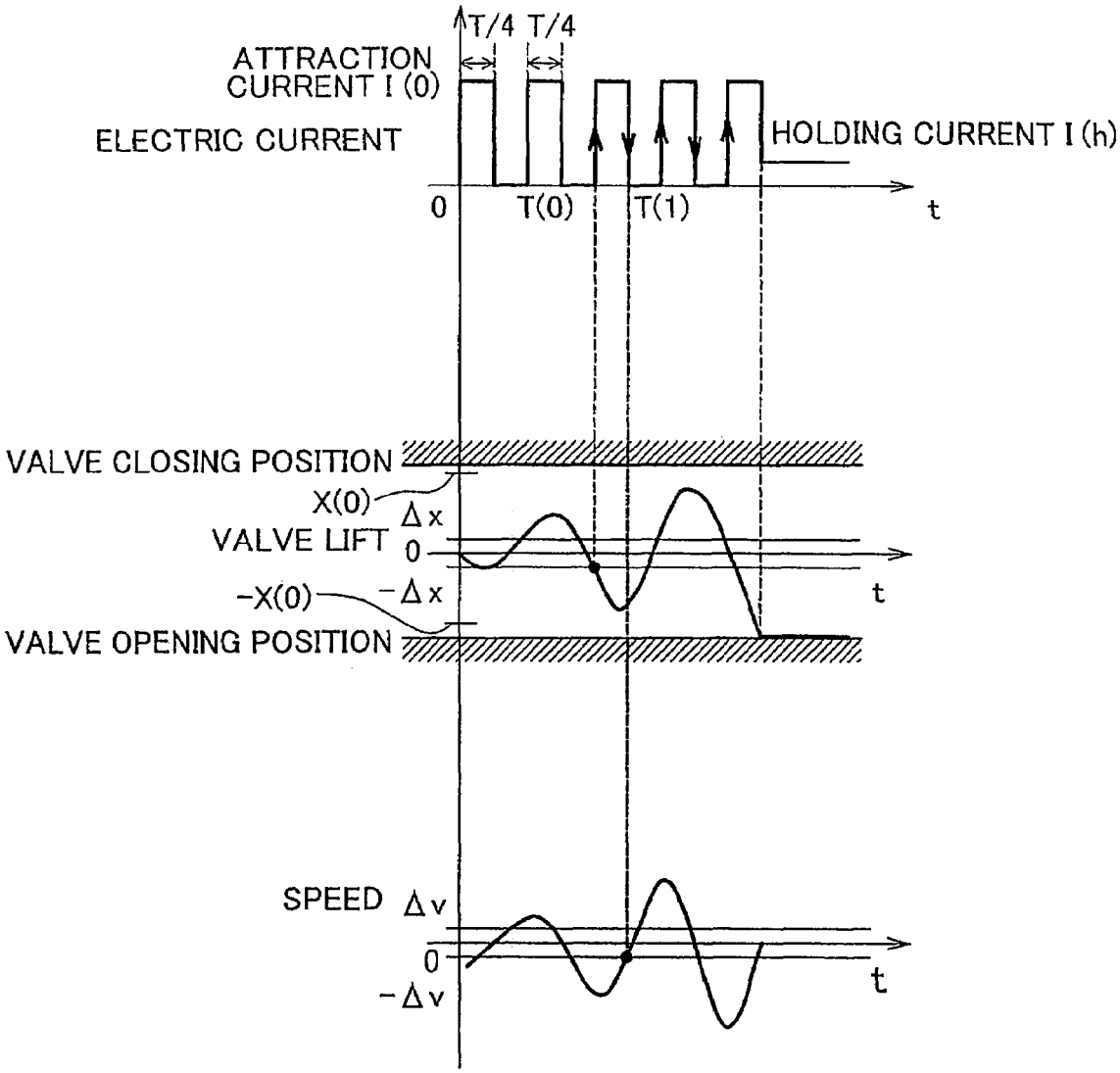
FIG. 10 illustrates a timing chart showing an operation of the electromagnetically driven valve controlled by the ECU that is the control unit for an electromagnetically driven valve according to the second embodiment.

As shown in a graph on the upper side in FIG. 10, when a request to start driving the drive valve 140 is detected at time "t=0" ("YES" in step S1000), counting using the counter is started in step S2000. When time-measurement using the timer is started in step S1010, and the attraction current I (0) is supplied to the open/close coil 620 in step S1020. While the period of T/4 has not elapsed ("NO" in step S1050), the attraction current I (0) is supplied to the open/close coil 620 in step S1020. At this time, since the drive valve 140 is held at a position slightly below the center position, a resultant force of the electromagnetic forces is applied in the direction in which the valve is opened. When the period of T/4 has elapsed ("YES" in step S1050), time-measurement is restarted in step S1060, and the supply of an electric current to the open/close coil 620 is stopped in step S1070. While the period of T/4 has not elapsed ("NO" in step S1090), the supply of an electric current to the open/close coil 620 is stopped. In this manner, supplying an electric current and stopping the supply of an electric current are repeated twice ("YES" in step S2020). Thus, a self-excited oscillation is generated in the drive valve 140.

When the self-excited oscillation has been generated, if it is determined that the coordinate point corresponding to the movement amount "x" of the drive valve 140 detected by the lift amount detection sensor 250 is changed from a value in the predetermined range (from the lower limit −Δx to the upper limit Δx) to a value outside the predetermined range at time "t=T (0)", as shown in a middle graph in FIG. 10 ("YES" in step S2050), the electric current I (0) is supplied to the open/close coil 620 in step S2060. At this time, a resultant force of the electromagnetic forces is applied from the open/close coil 620 to the drive valve 140 in the direction in which the valve is opened.

Then, as shown in a graph on the lower side in FIG. 10, when the coordinate point corresponding to the time-change-rate "v" based on the movement amount "x" of the drive valve 140 is changed from a value outside the predetermined range (the predetermined range being from the lower limit −Δv to the upper limit Δv) to a value in the predetermined range ("YES" in step S2090) at time "t=T (1)", the supply of an electric current to the open/close coil 620 is stopped. At this time, a elastic force of the upper spring 360 and the lower spring 260 for returning the drive valve 140 to the center position is applied to the drive valve 140. If the coordinate point corresponding to the movement amount "x" of the drive valve 140 is lower than the predetermined value −X (0) at time "t=T (h)", the holding current I (h) is supplied to the open/close coil 620.

As described so far, with the control unit for an electromagnetically driven valve 100 according to the second embodiment, when it is determined that the coordinate point corresponding to the detected movement amount "x" of the drive valve 140 is changed from a value in the predetermined range (from the lower limit −Δx to the upper limit Δx) to a value outside the predetermined range, control is performed such that the current I (0) is supplied to the open/close coil 620. When the coordinate point corresponding to the detected movement amount "x" is changed from a value in the predetermined range to a value outside the range, the drive valve 140 is near the center position and is moving toward the valve opening position. At this time, an electric current is supplied to the open/close coil 620, and the open/close coil 620 is caused to generate electromagnetic force. Thus, a resultant force of the electromagnetic forces is applied to the drive valve 140 in the direction in which the drive valve 140 moves. Accordingly, the extreme value of the movement amount "x" of the drive valve 140 increases. On the other hand, when it is determined that the coordinate point corresponding to the time-change-rate "v" of the movement amount of the drive valve 140 is changed from a value outside the predetermined range to a value in the predetermined range, control is performed such that the supply of an electric current to the open/close coil 620 is stopped. The position at which the coordinate point corresponding to the time-change-rate "v" is changed from a value outside the predetermined range to a value in the predetermined range is the position at which the time-change-rate "v" of the movement amount of the drive valve 140 becomes lower. The position at which the time-change-rate "v" becomes lower is the position at which the movement amount "x" of the drive valve becomes the extreme value. Therefore, the supply of an electric current to the open/close coil 620 is stopped. Accordingly, electromagnetic force is not applied to the drive valve 140, and only the elastic force of the upper spring 360 and the lower spring 260 for attempting to hold the drive valve 140 at the center position is applied to the drive valve 140. Accordingly, the time-change-rate "v" of the movement amount of the drive valve 140 increases as the drive valve 140 comes closer to the center position. If the electromagnetically driven valve 100 is controlled in this manner, the extreme value of the movement amount "x" of the drive valve 140 is increased, and the drive valve 140 can be moved to one of the valve opening position and the valve closing position.

Also, even when friction of the movable portion at a low temperature is high, or even when the spring constant of the upper spring 360 and the lower spring 260 is changed with time and therefore the actual oscillation cycle T deviates from the original value, the movable portion can be always operated in the optimum oscillation cycles. Therefore, an inappropriate self-excited oscillation does not occur, and, therefore, an increase in electric power consumption can be suppressed. In addition, since the drive valve 140 can be started reliably, the reliability can be improved.

Hereafter, a control unit for an electromagnetically driven valve according to a third embodiment will be described. The electromagnetically driven valve in the third embodiment has the same structure as that of the electromagnetically driven valve in the second embodiment. The same reference numerals are assigned to the same components. The components having the same reference numerals have the same functions. Accordingly, the detailed description concerning the components having the same reference numerals will not be made here.

The control unit for an electromagnetically driven valve according to the third embodiment is the same as the control unit for an electromagnetically driven valve according to the second embodiment except for a control structure of a program performed by the ECU 200.

The ECU 200 that is the control unit for an electromagnetically driven valve according to the third embodiment performs control so as to supply an electric current to the open/close coil 620 in a manner in which supplying an electric current to the open/close coil 620 during the period of T/4 and stopping the supply of an electric current to the open/close coil 620 during the period of T/4 are repeated in the initial oscillation cycle T of the movable portion, as in the case of the first embodiment. The ECU 200 then causes the movable portion to perform a self-excited oscillation. Then, the ECU 200 calculates a first distance between the upper disk 310 and the attraction surface 610A of the core 610 based on the movement amount "x" of the drive valve 140 detected by the lift amount detection sensor 250. Then, the ECU 200 calculates a second distance between the lower disk 210 and the attraction surface 610B of the core 610 based on the detected movement amount "x". When the absolute value of the difference between the first distance and the second distance is larger than a predetermined distance, the ECU 200 performs control such that an electric current is supplied to the open/close coil 620. On the other hand, when the absolute value of the difference between the first distance and the second distance is equal to or smaller than the predetermined distance, the ECU 200 performs control such that the supply of an electric current to the open/close coil 620 is stopped.

Figure 11:
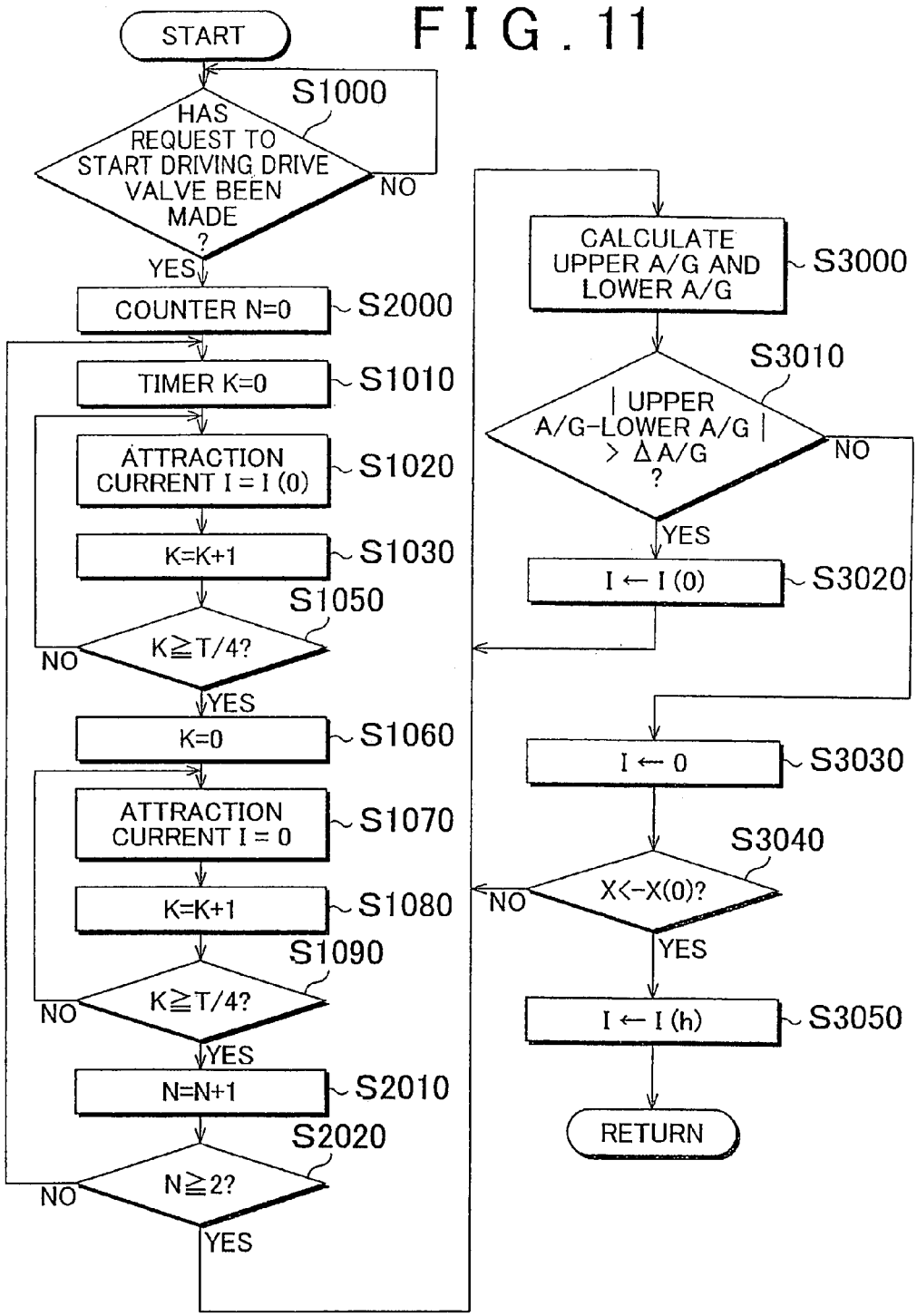
FIG. 11 illustrates a flowchart of a control structure of a program performed by an ECU that is a control unit for an electromagnetically driven valve according to a third embodiment of the invention.

Hereafter, a control structure of a program performed by the ECU 200 that is the control unit for an electromagnetically driven valve according to the third embodiment will be described with reference to FIG. 11. In the flowchart in FIG. 11, the same reference numerals are assigned to the same steps in the flowchart shown in FIG. 9. The processes in the steps having the same reference numerals are also the same. Accordingly, the detailed description concerning the steps having the same reference numerals will not be made here.

In step S3000, the ECU 200 calculates an upper air gap and a lower air gap based on the movement amount "x" of the drive valve 140 detected by the lift amount detection sensor 250. Here, the "upper air gap" is the distance between the upper disk 310 and the attraction surface 610A of the core 610, and the "lower air gap" is the distance between the lower disk 210 and the attraction surface 610 of the core 610. The reference line used for calculating the upper air gap and the lower air gap is not particularly limited as long as the reference line extends in the direction in which the drive valve 140 moves. In the third embodiment, the upper air gap is the vertical distance between an end portion 630A of the attraction surface 610A of the core 610 and the upper disk 310. The lower air gap is the vertical distance between an end portion 630B of the attraction surface 610B of the core 610 and the lower disk 210.

In step S3010, the ECU 200 determines whether the absolute value of the difference between the upper air gap and the lower air gap is larger than a predetermined value ΔA/G When it is determined that the absolute value of the difference between the upper air gap and the lower air gap is larger than the predetermined value ΔA/G ("YES" in step S3010), step S3020 is performed. On the other hand, when it is determined that the absolute value of the difference between the upper air gap and the lower air gap is equal to or smaller than the predetermined value ΔA/G ("NO" in step S3010), step S3030 is performed.

In step S3030, the ECU 200 performs control such that the supply of an electric current to the open/close coil 620 is stopped. In step S3040, the ECU 200 determines whether the coordinate point corresponding to the movement amount "x" detected by the lift amount detection sensor 250 is lower than the predetermined value −X (0). When it is determined that the coordinate point corresponding to the movement amount "x" of the drive valve 140 is lower than the predetermined value −X (0) ("YES" in step S3040), step S3050 is performed. If not ("NO" in step S3040), step S3000 is performed. In step S3050, the ECU 200 performs control such that the holding current I (h) is supplied to the open/close coil 620.

An operation of the ECU 200 that is the control unit for an electromagnetically driven valve according to the third embodiment based on the above-mentioned structure and flowchart will be described with reference to FIG. 12. In the third embodiment, a description will be made on the assumption that the electromagnetically driven valve 100 is an exhaust valve. Namely, when a request to start driving the drive valve 140 has been made, the ECU 200 performs control such that the driving valve 140 is moved to the valve opening position.

Figure 12:
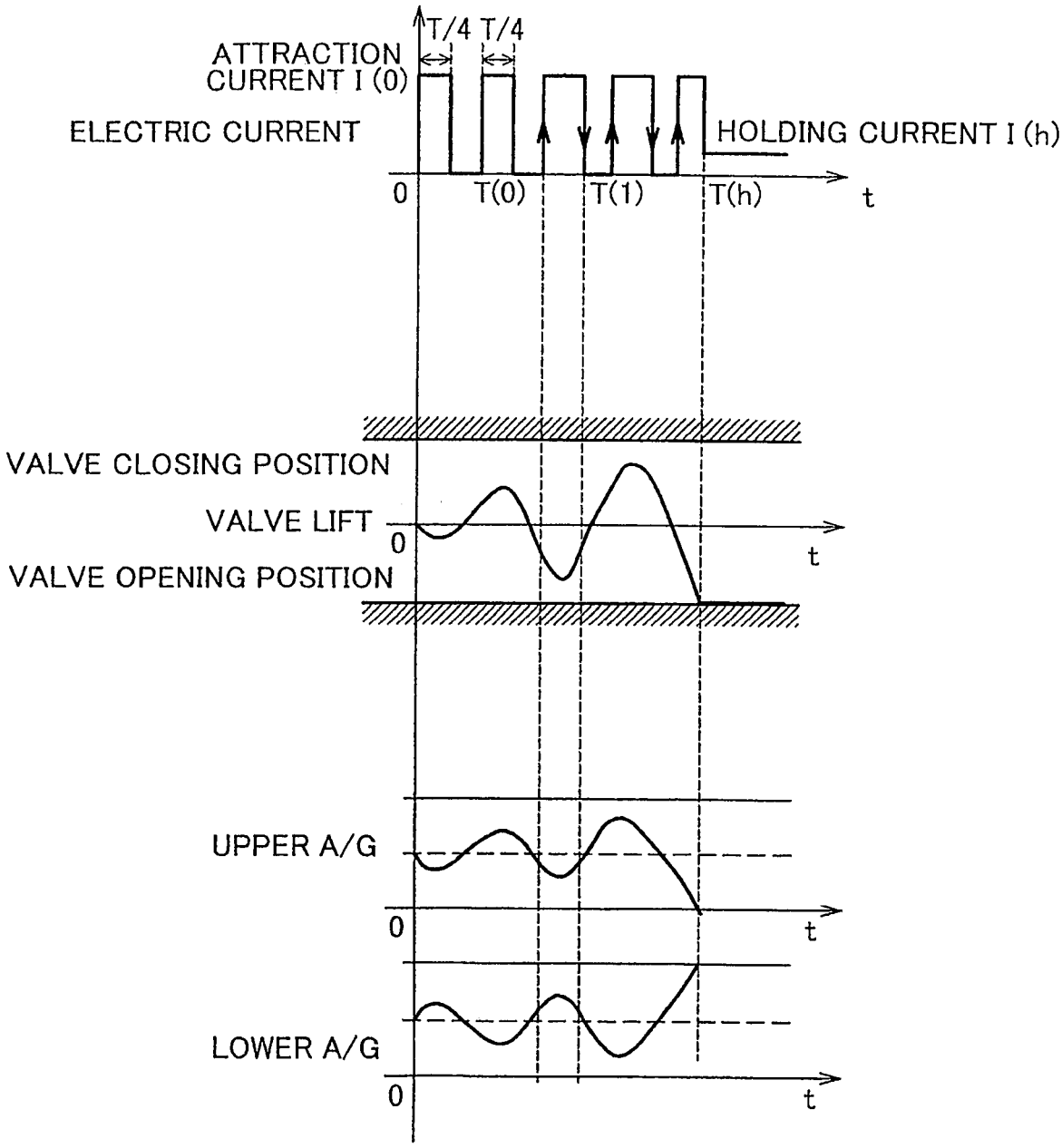
FIG. 12 illustrates a timing chart showing an operation of the electromagnetically driven valve controlled by the ECU that is the control unit for an electromagnetically driven valve according to the third embodiment.

As shown in a graph on the upper side in FIG. 12, when a request to start driving the drive valve 140 is detected at time "t=0" ("YES" in step S1000), counting using the counter is started in step S2000. When time-measurement using the timer is started in step S1010, the attraction current I (0) is supplied to the open/close coil 620 in step S1020. While the period of T/4 has not elapsed ("NO" in step S1050), the attraction current I (0) is supplied to the open/close coil 620 in step S1020. At this time, since the drive valve 140 is held at a position slightly below the center position, a resultant force of the electromagnetic forces is applied to the drive valve 140 in the direction in which the valve is opened. When the period of T/4 has elapsed ("YES" in step S1050), time-measurement is re-started in step S1060, and the supply of an electric current to the open/close coil 620 is stopped in step S1070. While the period of T/4 has not elapsed ("NO" in step S1090), the supply of an electric current to the open/close coil 620 is stopped. In this manner, supplying an electric current to the open/close coil 620 and stopping the supply of the electric current to the open/close coil 620 are repeated twice ("YES" in step S2020). Thus, the drive valve 140 is caused to perform a self-excited oscillation.

In the state where a self-excited oscillation is caused, as shown in a graph on the lower side in FIG. 12, when the absolute value of the difference between the upper air gap and the lower air gap based on the movement amount "x" of the drive valve 140 detected by the lift amount detection sensor 250 becomes larger than the predetermined value ΔA/G ("YES" in step S3010), the electric current I (0) is supplied to the open/close coil 620 in step S3020.

When the absolute value of the difference between the upper air gap and the lower air gap becomes equal to or smaller than the predetermined value ΔA/G at time "t=T (1)" ("NO" in step S3010) at time "t=T (0)", the supply of an electric current to the open/close coil 620 is stopped. When the coordinate point corresponding to the movement amount "x" of the drive valve 140 is lower than the predetermined value −X (0) at time "t=T (h)", the holding current I (h) is supplied to the open/close coil 620.

As described so far, with the control unit for an electromagnetically driven valve according to the third embodiment, the upper air gap between the upper disk 310 and the attraction surface 610 A of the core 610 is calculated based on the detected movement amount "x". Also, the lower air gap between the lower disk 210 and the attraction surface 610B of the core 610 is calculated based on the detected movement amount "x". When the absolute value of the difference between the upper air gap and the lower air gap is small, the drive valve 140 is near the center position. While the drive valve 140 is near the center position, even if an electric current is supplied to the open/close coil 620 so as to cause the open/close coil 620 to generate electromagnetic force, a resultant force of the electromagnetic forces applied to the drive valve 140 is small, and electric power consumption is increased. Accordingly, supplying an electric current to the open/close coil 620 when the absolute value of the difference between the upper air gap and the lower air gap is larger than the predetermined value ΔA/G makes it possible to increase the resultant force of the electromagnetic forces applied to the drive valve 140, thereby increasing the extreme value of the movement amount "x" of the drive valve 140. Therefore, the drive valve 140 can be moved to the desired position from among the valve closing position and the valve opening position. Also, stopping the supply of an electric current to the open/close coil 620 when the absolute value of the difference between the upper air gap and the lower air gap is smaller than the predetermined value ΔA/G makes it possible to suppress electric power consumption.

Hereafter, a control unit for an electromagnetically driven valve according to a fourth embodiment of the invention will be described. The electromagnetically driven valve in the fourth embodiment has the same structure as that of the electromagnetically driven valve 100 in the first embodiment. The same reference numerals are assigned to the same components. The functions of the components having the same reference numerals are also the same. Accordingly, the detailed description concerning the components having the same reference numerals will not be made here.

The control unit for an electromagnetically driven valve according to the fourth embodiment is the same as the control unit for an electromagnetically driven valve according to the first embodiment except for a control structure of a program performed by the ECU 200.

The ECU 200 that is the control unit for an electromagnetically driven valve according to the fourth embodiment performs control such that an electric current is supplied to the open/close coil 620 until the movement amount "x" of the drive valve 140 detected by the lift amount detection sensor 250 becomes equal to a predetermined movement amount. Then, when the detected movement amount "x" becomes equal to the predetermined movement amount (when the drive valve 140 reaches the valve opening position), the ECU 200 performs control such that the supply of an electric current to the open/close coil 620 is stopped. When it is determined that the drive valve 140 reaches the center position based on the detected movement amount, the ECU 200 performs control such that an electric current is supplied to the open/close coil 620.

Figure 13:
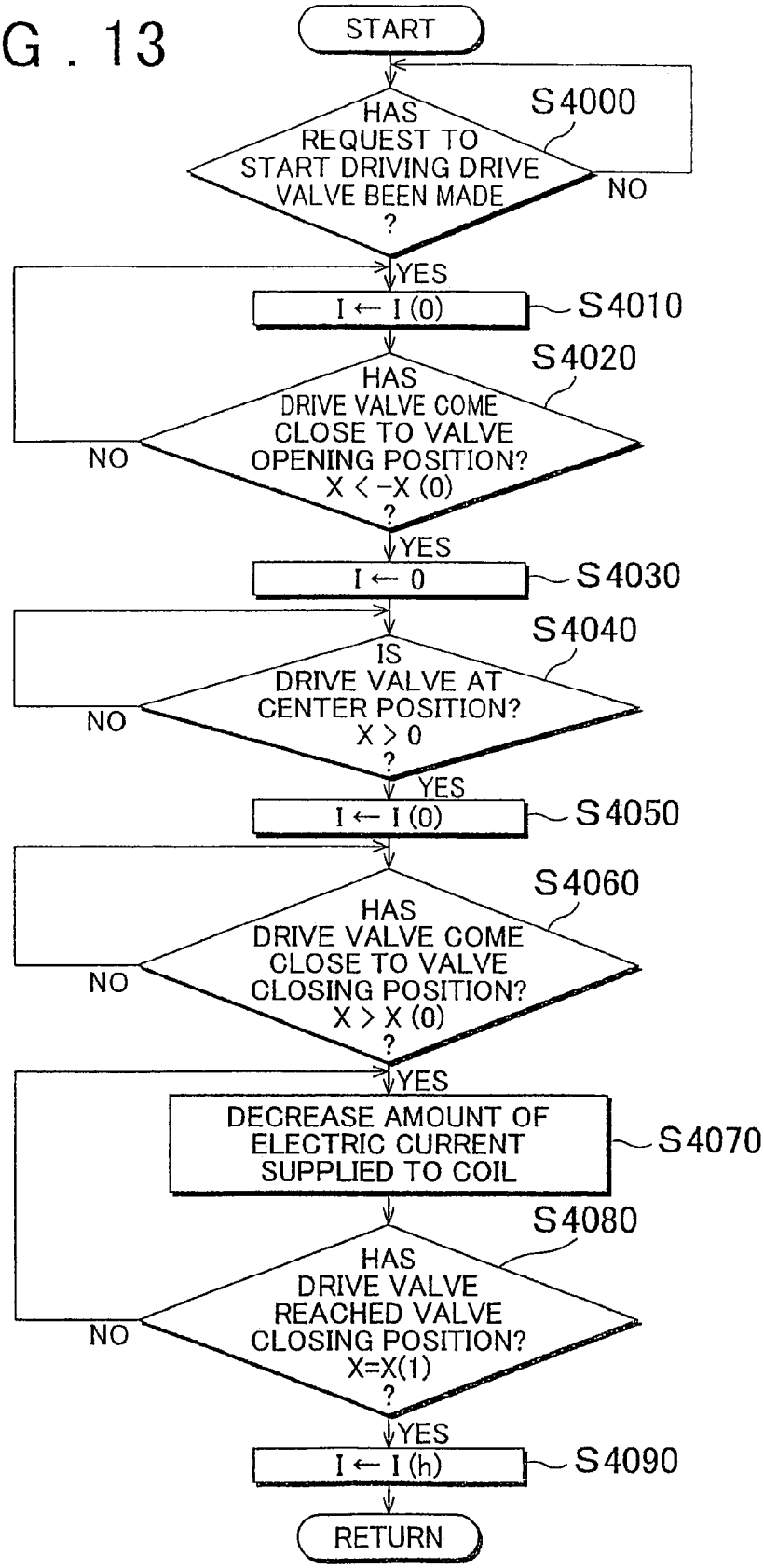
FIG. 13 is a flowchart showing a control structure of a program performed by an ECU that is a control unit for an electromagnetically driven valve according to a fourth embodiment of the invention.

Hereafter, a control structure of a program performed by the ECU 200 that is the control unit for an electromagnetically driven valve according to the fourth embodiment will be described with reference to FIG. 13.

In step S4000, the ECU 200 determines whether a request to start driving the drive valve 140 has been made. When it is determined that a request to start driving the drive valve 140 has been made ("YES" in step S4000), step S4010 is performed. If it is determined that the a request to start driving the drive valve 140 has not been made ("NO" in step S4000), the ECU 200 is placed in the stand-by mode until a request to start driving the drive valve 140 is made.

In step S4010, the ECU 200 performs control such that the electric current I(0) is supplied to the open/close coil 620. In step S4020, the ECU 200 determines whether the drive valve 140 comes close to the valve opening position based on the movement amount "x" of the drive valve 140 detected by the lift amount detection sensor 250. More specifically, the ECU 200 determines whether the coordinate point corresponding to the detected movement amount "x" of the drive valve 140 is lower than the predetermined value −X (0) that is close to the valve opening position. When it is determined that the drive valve 140 has come close to the valve opening position ("YES" in step S4020), step S4030 is performed. If it is determined that the drive valve 140 has not come close to the valve opening position ("NO" in step S4020), step S4010 is performed.

In step S4030, the ECU 200 performs control such that the supply of an electric current to the open/close coil 620 is stopped. In step S4040, the ECU 200 determines whether the drive valve 140 is at the center position based on the detected movement amount "x" of the drive valve 140. When it is determined that the drive valve 140 is at the center position ("YES" in step S4040), step S4050 is performed. On the other hand, when it is determined that the drive valve 140 is not at the center position ("NO" in step S4040), the ECU 200 is placed in the stand-by mode until the drive valve 140 reaches the center position.

In step S4050, the ECU 200 performs control such that the electric current I(0) is supplied to the open/close coil 620. In step S4060, the ECU 200 determines whether the drive valve 140 comes close to the valve closing position based on the detected movement amount "x" of the drive valve 140. More specifically, the ECU 200 determines whether the coordinate point corresponding to the detected movement amount "x" of the drive valve 140 is higher than the predetermined movement value X (0) that is close to the valve closing position. When it is determined that the drive valve 140 has come close to the valve closing position ("YES" in step S4060), step S4070 is performed. On the other hand, when it is determined that the drive valve 140 has not come close to the valve closing position ("NO" in step S4060), step S4050 is performed.

In step S4070, the ECU 200 performs control such that an amount of electric current supplied to the open/close coil 620 is decreased. In step S4080, the ECU 200 determines whether the drive valve 140 has moved to the valve closing position. More specifically, the ECU 200 determines whether the coordinate point corresponding to the detected movement amount "x" of the drive valve 140 is equal to the predetermined value X (1) corresponding to the valve closing position. When it is determined that the drive valve 140 has moved to the valve closing position ("YES" in step S4080), step S4090 is performed. On the other hand, when it is determined that the drive valve 140 has not moved to the valve closing position ("NO" in step S4080), the ECU 200 is placed in the stand-by mode until the drive valve 140 moves to the valve closing position. In step S4090, the ECU 200 performs control such that the holding current I (h) is supplied to the open/close coil 620.

An operation of the ECU 200 that is the control unit for an electromagnetically driven valve according to the fourth embodiment based on the above-mentioned structure and flowchart will be described with reference to FIG. 14. In the fourth embodiment, a description will be made on the assumption that the electromagnetically driven valve is an intake valve. Namely, when a request to start driving the drive valve 140 has been made, the ECU 200 performs control such that the drive valve 140 is moved to the valve closing position.

Figure 14:
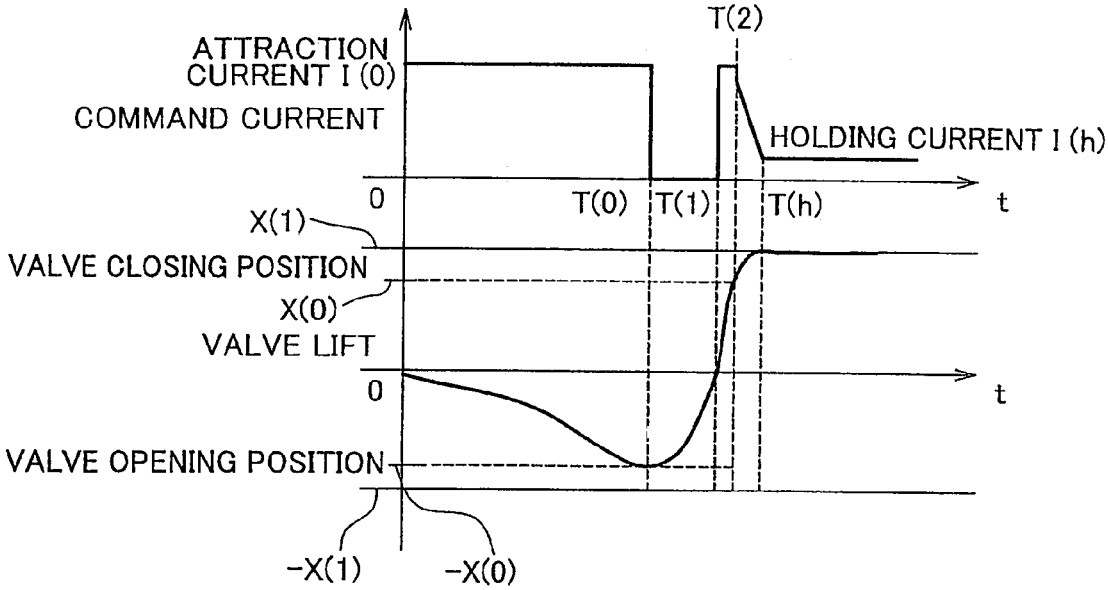
FIG. 14 is a timing chart showing an operation of the electromagnetically driven valve controlled by the ECU that is the control unit for an electromagnetically driven valve according to the fourth embodiment.

As shown in a graph on the upper side in FIG. 14, when a request to start driving the drive valve 140 is made at time "t=0" ("YES" in step S4000), the electric current I (0) is supplied to the open/close coil 620 in step S4010. Since the drive valve 140 is held at a position slightly below the center position, the drive valve 140 moves in the direction in which the valve is opened due to electromagnetic force generated by the open/close coil 620.

As shown in a graph on the lower side in FIG. 14, when the drive valve 140 comes close to the valve opening position at time "t=T (0)" (when the coordinate point corresponding to the movement amount "x" of the drive valve 140 becomes lower than the predetermined value −X (0)) ("YES" in step S4020), the supply of an electric current to the open/close coil 620 is stopped in step S4030. At this time, force for returning the drive valve 140 to the center position is applied to drive valve 140 due to the elastic force of the upper spring 360 and the lower spring 260. When the drive valve 140 passes the center position at time "t=T (1)" ("YES" in step S4040), the electric current I (0) is supplied to the open/close coil 620. When the drive valve 140 passes the center position, a resultant force of an inertiforce, the elastic force of the upper spring 360 and the lower spring 260, and electromagnetic force applied in the direction in which the drive valve 140 moves is applied to the drive valve 140.

When the drive valve 140 comes close to the valve closing position at time "t=T (2)" (when the coordinate point corresponding to the movement amount "x" of the drive valve 140 becomes higher than the predetermined value X (0)) ("YES" in step S4060), an amount of electric current supplied to the open/close coil 620 is decreased in step S4070. When the drive valve 140 reaches the valve closing position at time "t=T (h)" (when the coordinate point corresponding to the movement amount "x" of the drive valve 140 becomes equal to the predetermined value X (1)) ("YES" in step S4080), the holding current I (h) is supplied to the open/close coil 620.

As described so far, with the control unit for an electromagnetically driven valve according to the fourth embodiment, the ECU 200 performs control such that an electric current is supplied to the open/close coil 620 until the detected movement amount "x" of the drive valve 140 becomes equal to the predetermined movement amount. Since the drive valve 140 is held at a position slightly below the center position, if electromagnetic force generated by the electromagnet 600 is applied to the drive valve 140, the drive valve 140 moves downward. The ECU 200 performs control such that the supply of an electric current to the open/close coil 620 is stopped when the position of the drive valve 140 based on the detected movement amount "x" reaches the valve opening position. Thus, the drive valve 140 moves toward the center position due to the elastic force of the upper spring 360 and the lower spring 260 for attempting to hold the drive valve 140 at the center position. The ECU 200 performs control such that an electric current is supplied to the open/close coil 620 when the position of the drive valve 140 based on the detected movement amount "x" reaches the center position. Thus, after the drive valve 140 passes the center position, electromagnetic force is applied in the same direction as the direction in which the drive valve 140 moves. Therefore, the drive valve 140 can be controlled to move to the valve closing position.

Also, since the drive valve 140 is once moved to the valve opening position, stable control can be performed. In addition, the drive valve 140 can be moved to the valve closing position. Therefore, for example, the situation can be prevented in which, when the engine is started at a high temperature with the intake valve fully opened, new air flows from an intake system to an exhaust system, and a catalytic reaction is promoted, resulting in damage of a catalyst due to excessive overheating.

In the above-mentioned embodiments, the electromagnetically driven valve includes the electromagnet formed of a piece of coil, that is, a mono-coil; and the rotary driven type parallel link mechanism in which plural oscillation members are provided and the drive valve is reciprocated due to the oscillating movement of the oscillation members. However, the structure of the electromagnetically driven valve is not particularly limited to this. Any type of an electromagnetically driven valve can be employed, as long as an electromagnetically driven valve is employed in which, if an electric current is supplied to the coil when the drive valve is at the neutral position, electromagnetic force for opening the valve, and electromagnetic force for closing the valve that is equal to the electromagnetic force for opening the valve are applied to the oscillation members, and the neutral position of the drive valve is slightly below or slightly above the center position. For example, the electromagnetically driven valve may include multiple coils. Also, a parallel drive type electromagnetically driven valve may be used.

The embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

The invention claimed is:

1. A control unit for an electromagnetically driven valve including:

a drive valve that includes a valve stem and that reciprocates between a first position and a second position in a direction in which the valve stem extends;

an oscillation member which is connected to the valve stem;

an elastic member which applies elastic force to the oscillation member such that the drive valve is held at a predetermined position between the first position and the second position; and a magnetic force generating device for applying electromagnetic force to the oscillation member based on electric power supplied to the magnetic force generating device, wherein the magnetic force generating device applies electromagnetic force for moving the drive valve toward the first position and electromagnetic force for moving the drive valve toward the second position, which is equal to the electromagnetic force for moving the drive valve toward the first position, to the oscillation member, if the electric power is applied to the magnetic force generating device when the drive valve is at a center position between the first position and the second position, and the predetermined position is deviated from the center position toward the first position or the second position, the electromagnetically driven valve operating by using both the electromagnetic force and the elastic force, the control unit comprising:

an electric power supplying device for supplying electric power to the magnetic force generating device;

a detecting device for detecting a movement amount of the drive valve; and a control device for controlling a supply of electric power to the magnetic force generating device according to one of an oscillation cycle based on the elastic force and the movement amount of the drive valve, wherein the magnetic force generating device is an electromagnet formed of a piece of coil and the control device controls an electric power supply period and an electric power supply stopped period according to the oscillation cycle based on the elastic force, and performs control such that an amount of electric power supplied to the magnetic force generating device becomes equal to a predetermined amount of electric power, when the movement amount becomes equal to a predetermined movement amount.

2. The control unit for an electromagnetically driven valve according to claim 1, wherein the control device controls an electric power supply period and an electric power supply stopped period according to the oscillation cycle based on the elastic force, and determines whether the movement amount is in a predetermined range, performs control such that the electric power is supplied to the magnetic force generating device, when it is determined that the movement amount is changed from a value in the predetermined range to a value outside the predetermined range, determines whether a time-change-rate of the movement amount is in a predetermined range, and performs control such that the supply of electric power to the magnetic force generating device is stopped, when it is determined that the time-change rate is changed from a value outside the predetermined range to a value in the predetermined range.

3. The control unit for an electromagnetically driven valve according to claim 2, wherein the control device performs control such that an amount of electric power supplied to the magnetic force generating device becomes equal to a predetermined amount of electric power, when the movement amount becomes equal to the predetermined movement amount.

4. The control unit for an electromagnetically driven valve according to claim 1, wherein the oscillation member is formed of a first oscillation member and a second oscillation member which are provided at a predetermined distance from each other, and the control device controls an electric power supply period and an electric power supply stopped period according to the oscillation cycle based on the elastic force, calculates a first distance between the first oscillation member and a predetermined reference position based on the movement amount, calculates a second distance between the second oscillation member and the reference position based on the movement amount, performs control such that the electric power is supplied to the magnetic force generating device, when an absolute value of a difference between the first distance and the second distance is larger than a predetermined distance, and performs control such that the supply of electric power to the magnetic force generating device is stopped, when the absolute value of the difference between the first distance and the second distance is equal to or smaller than the predetermined distance.

5. The control unit for an electromagnetically driven valve according to claim 4, wherein the control device performs control such that an amount of electric power supplied to the magnetic force generating device becomes equal to a predetermined amount of electric power, when the movement amount becomes equal to the predetermined movement amount.

6. The control unit for an electromagnetically driven valve according to claim 1, wherein the control device supplies the electric power to the magnetic force generating device until the movement amount becomes equal to a predetermined movement amount, performs control such that the supply of electric power to the magnetic force generating device is stopped, when the movement amount becomes equal to the predetermined movement amount, and performs control such that the electric power is supplied to the magnetic force generating device, when a position of the drive valve based on the movement amount becomes the center position.

7. The control unit for an electromagnetically driven valve according to claim 6, wherein the control device performs control such that an amount of electric power supplied to the magnetic force generating device becomes equal to a predetermined amount of electric power, when the movement amount becomes equal to the predetermined movement amount.

8. The control unit for an electromagnetically driven valve according to claim 1, wherein electromagnetic force for stopping reciprocation of the drive valve is applied to the drive valve by supplying the predetermined amount of electric power.

9. The control unit for an electromagnetically driven valve according to claim 1, wherein the electromagnetically driven valve is a parallel link type electromagnetically driven valve.

* * * * *